US009234689B2

(12) United States Patent
Son et al.

(10) Patent No.: US 9,234,689 B2
(45) Date of Patent: Jan. 12, 2016

(54) ICE MAKER

(75) Inventors: Juhyun Son, Gyeongsangnam-do (KR); Wookyong Lee, Gyeongsangnam-do (KR); Donghoon Lee, Gyeongsangnam-do (KR); Dongjeong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 641 days.

(21) Appl. No.: 13/548,649

(22) Filed: Jul. 13, 2012

(65) Prior Publication Data

US 2013/0014535 A1 Jan. 17, 2013

(30) Foreign Application Priority Data

Jul. 15, 2011 (KR) ..... 10-2011-0070690

(51) Int. Cl.

*F25C 1/10* (2006.01)
*F25C 5/06* (2006.01)
*F25C 5/08* (2006.01)

(52) U.S. Cl.

CPC ... *F25C 1/10* (2013.01); *F25C 5/06* (2013.01); *F25C 5/08* (2013.01)

(58) Field of Classification Search

CPC ..... F25C 2305/022; F25C 1/00; F25C 1/10; F25C 1/22; F25C 1/225; F25C 1/24; F25C 1/243

See application file for complete search history.

(56) References Cited

U.S. PATENT DOCUMENTS 4,417,716 A * 11/1983 Penna et al. ..... 249/121
4,910,974 A * 3/1990 Hara ..... 62/347
5,701,235 A 12/1997 Hagemeyer
5,970,725 A * 10/1999 Lee ..... 62/137
6,658,869 B1 * 12/2003 Thornbrough ..... 62/137
6,857,277 B2 * 2/2005 Somura ..... 62/74
7,628,030 B2 * 12/2009 Visin et al. ..... 62/344
2005/0097903 A1 * 5/2005 Son et al. ..... 62/135
2007/0107447 A1 * 5/2007 Langlotz ..... 62/66

(Continued)

FOREIGN PATENT DOCUMENTS

CN 1435663 A 8/2003
FR 2437590 A1 4/1980

(Continued)

OTHER PUBLICATIONS

Japanese Office Action dated Jun. 11, 2013 for Japanese Application No. 2012-157878, with English Translation, 6 pages.

(Continued)

*Primary Examiner* — Frantz Jules
*Assistant Examiner* — Erik Mendoza-Wilkenfel
(74) *Attorney, Agent, or Firm* — Fish & Richardson P.C.

(57) ABSTRACT

Provided is an ice maker. The ice maker includes a tray member comprising an upper tray having an upper shell and a lower tray having a lower shell. The ice maker also includes a driving unit disposed on a side of the tray member and configured to linearly move, in a vertical direction, at least one of the upper tray and the lower tray to change between an attached orientation in which the upper shell is attached to the lower shell to define a spherical shell and a separated orientation in which the upper shell is separated from the lower shell. The ice maker further includes an ejecting unit that is disposed on a side of the tray member and that is configured to facilitate separation of an ice piece made in the spherical shell from at least one of the upper tray and the lower tray.

9 Claims, 33 Drawing Sheets

(56) References Cited

U.S. PATENT DOCUMENTS

| | | | | |
|---|---|---|---|---|
| 2009/0019880 | A1* | 1/2009 | Lee et al. | 62/345 |
| 2009/0145159 | A1* | 6/2009 | Kim et al. | 62/353 |
| 2009/0308085 | A1 | 12/2009 | DeVos | |
| 2010/0101261 | A1 | 4/2010 | Yoon | |
| 2010/0205996 | A1* | 8/2010 | Ducharme et al. | 62/351 |
| 2010/0319367 | A1* | 12/2010 | Kim et al. | 62/71 |
| 2011/0192175 | A1* | 8/2011 | Kuratani et al. | 62/72 |

FOREIGN PATENT DOCUMENTS

| | | | |
|---|---|---|---|
| JP | 59-049475 | A | 3/1984 |
| JP | 59-081473 | A | 5/1984 |
| JP | 62-285764 | A | 12/1987 |
| JP | 02-154962 | A | 6/1990 |
| JP | 02-176380 | A | 7/1990 |
| JP | 02176380 | A * | 7/1990 |
| JP | 2005-326035 | A | 11/2005 |
| KR | 10-2011-0037609 | A | 4/2011 |

OTHER PUBLICATIONS

Japanese Office Action dated Jun. 11, 2013 for Application No. 2012-157878, 4 pages.

European Search Report dated Aug. 11, 2015 for European Application No. 12005184, 7 Pages.

SIPO Patent Certificate dated Sep. 16, 2015 for CN No. 102878744 B, 39 pages.

* cited by examiner

ICE MAKER

CROSS-REFERENCE TO RELATED APPLICATIONS

The present application claims the benefit of priority to Korean Patent Application No. 10-2011-0070690 (filed on Jul. 15, 2011), which is herein incorporated by reference in its entirety.

FIELD

This disclosure relates to an ice maker.

BACKGROUND

In general, refrigerators are home appliances for storing foods at a low temperature in an inner storage space covered by a door. That is, since such a refrigerator cools the inside of the storage space using cool air generated by heat-exchanging with a refrigerant circulating a refrigeration cycle, foods stored in the storage space may be stored in a refrigerated or frozen state.

Also, an ice maker for making ice may be provided inside the refrigerator. The ice maker is configured so that water supplied from a water supply source or a water tank is received into an ice tray to make ice. Also, the ice maker is configured to separate the made ice from the ice tray by heating or twisting the ice tray.

As described above, the ice maker in which water is automatically supplied and ices are automatically separated may have a structure which is opened upward to lift the made ices up. Also, each of ices made in the ice maker having the above-described structure may have a shape having at least one flat surface, such as a crescent moon shape or a cubic shape.

SUMMARY

In one aspect, an ice maker includes a tray member including an upper tray having an upper shell and a lower tray having a lower shell. The ice maker also includes a driving unit disposed on a side of the tray member and configured to linearly move, in a vertical direction, at least one of the upper tray and the lower tray to change between an attached orientation in which the upper shell is attached to the lower shell to define a spherical shell and a separated orientation in which the upper shell is separated from the lower shell. The ice maker further includes an ejecting unit that is disposed on a side of the tray member and that is configured to facilitate separation of an ice piece made in the spherical shell from at least one of the upper tray and the lower tray.

Implementations may include one or more of the following features. For example, the driving unit may be configured to move the lower tray downward and then rotate the lower tray to facilitate separation of the ice piece. In addition, the ice maker may include a water supply unit disposed on the upper tray to supply water into the lower shell and a water supply guide part defined in the lower tray and configured to guide the water supplied from the water supply unit into the lower shell.

In some implementations, the driving unit may include a motor configured to provide a rotation force, a pinion gear connected to a rotation shaft of the motor, and a rack gear disposed on a side surface part of the lower tray. In these implementations, the rack gear may be engaged with the pinion gear to move the lower tray. Further, in these implementations, the rack gear may include a vertical part configured to vertically move the lower tray and a rotation part that is bent with a predetermined curvature from an upper end of the vertical part and that is configured to rotate the lower tray.

The ice maker also may include a guide groove defined in a side surface of the rack gear and a guide protrusion that protrudes from a side surface of a case in which the tray member is received. The guide protrusion may be fitted into the guide groove to guide movement of the rack gear. The ice maker further may include a guide roller that contacts a surface of the rack gear opposite to that on which the rack gear is engaged with the pinion gear.

In some examples, the ejecting unit may include a lower heater mounted on an outer surface of the lower tray and an upper heater mounted on an outer surface of the upper tray. In these examples, the lower heater may be operated before the lower tray is moved after the ice piece is made, and the upper heater may be operated after the lower tray is moved.

In some implementations, the ejecting unit may include a lower heater mounted on an outer surface of the lower tray and an ejector disposed above the upper tray. In these implementations, the ejector may pass through the upper shell to separate the ice piece from the upper tray. In addition, in these implementations, the driving unit may be configured to move the ejector in conjunction with movement of the lower tray.

In some examples, the driving unit may include a motor configured to provide a rotation force, a pinion gear connected to a rotation shaft of the motor, and a rack gear disposed on a side surface part of the lower tray and engaged with the pinion gear to move the lower tray. In these examples, the ejecting unit may include a lower heater mounted on an outer surface of the lower tray, a disk configured to receive a rotation force from the rotation shaft of the motor, a rod having a first end connected to the disk, and an ejector connected to a second end of the rod. The ejector may pass through a top surface of the upper shell to separate the ice piece from the upper shell.

In some implementations, the driving unit may include a motor configured to provide a rotation force, a pinion gear connected to a rotation shaft of the motor, and a rack gear disposed on a side surface part of the lower tray and engaged with the pinion gear to move the lower tray. In these implementations, the ejecting unit may include a lower heater mounted on an outer surface of the lower tray, an ejecting rack gear elevated by being engaged with the pinion gear, a link having a first end connected to the ejecting rack gear, and an ejector connected to a second end of the link. The ejector may pass through a top surface of the upper shell to separate the ice piece from the upper shell. A position of the link may be rotatably connected to the upper tray.

In some examples, the driving unit may include a motor configured to provide a rotation force, a pinion gear connected to a rotation shaft of the motor, and a rack gear disposed on a side surface part of the lower tray and engaged with the pinion gear to move the lower tray. In these examples, the ejecting unit may include a lower heater mounted on an outer surface of the lower tray, a cam gear gear-coupled to the rack gear at a point at which rotation of the rack gear starts, a cam connected to a rotation shaft of the cam gear, and an ejector disposed under the cam to pass through an air hole defined in a top surface of the upper shell according to the rotation of the cam.

In some implementations, the driving unit may include a motor configured to provide a rotation force, a pinion gear connected to a rotation shaft of the motor, and a rack gear disposed on a side surface part of the upper tray. In these implementations, the rack gear may be engaged with the pinion gear to move the upper tray. Also, in these implementations, the rack gear may include a vertical part configured to vertically move the upper tray and a rotation part that is rounded backwardly with a predetermined curvature from a rear end of the vertical part and that is configured to rotate the upper tray. The pinion gear may be gear-coupled to a rear surface of the rack gear.

The ice maker may include a guide groove defined in a side surface of the rack gear and a guide protrusion that protrudes from a side surface of a case in which the tray member is received. The guide protrusion may be fitted into the guide groove to guide movement of the rack gear.

In some examples, the ejecting unit may include a lower heater mounted on an outer surface of the lower tray and an ejector configured to press a top surface of the upper shell to separate the ice piece from the upper shell. In these examples, the ejector may include an insertion part having a lower end that inserts into the upper shell when the upper tray ascends to an uppermost position thereof and rotates, a connection part that extends from an upper end of the insertion part in a direction perpendicular to the insertion part, and a push part extending from an end of the connection part in a same direction as the insertion part extends from the connection part. The push part may inclinedly extend in direction in which an end thereof gradually approaches toward the insertion part. After the insertion part is inserted into the upper shell, the ejector and the upper tray may be rotated together with each other.

In some implementations, the driving unit may include a motor configured to vertically move the upper tray, and the ejecting unit may include a lower heater mounted on an outer surface of the lower tray, an ejecting pin that protrudes downward from a position above the upper tray and that is configured to press the upper shell when the upper tray is moved to an uppermost position, and an ice separation guide rotatably mounted on a frame extending upward from a rear surface of the lower tray. In these implementations, the ice separation guide may be configured to guide the ice piece dropping from the upper tray into an ice storage space. Also, in these implementations, the ice maker may include an elastic member that is mounted on a coupling member connecting the ice separation guide to the frame and that is configured to apply an elastic force that rotates the ice separation guide forward, and a stopper disposed on the frame to define a rotation limit of the ice separation guide. Further, in these implementations, in a state where the upper tray is attached to the lower tray, the ice separation guide may be restricted by the upper tray to maintain a state in which the ice separation guide is attached to the frame. When the upper tray ascends from the lower tray to release the restriction of the ice separation guide, the ice separation guide may be rotated forward by an elastic force of the elastic member.

The details of one or more implementations are set forth in the accompanying drawings and the description below. Other features will be apparent from the description and drawings, and from the claims.

DETAILED DESCRIPTION

Figure 1:
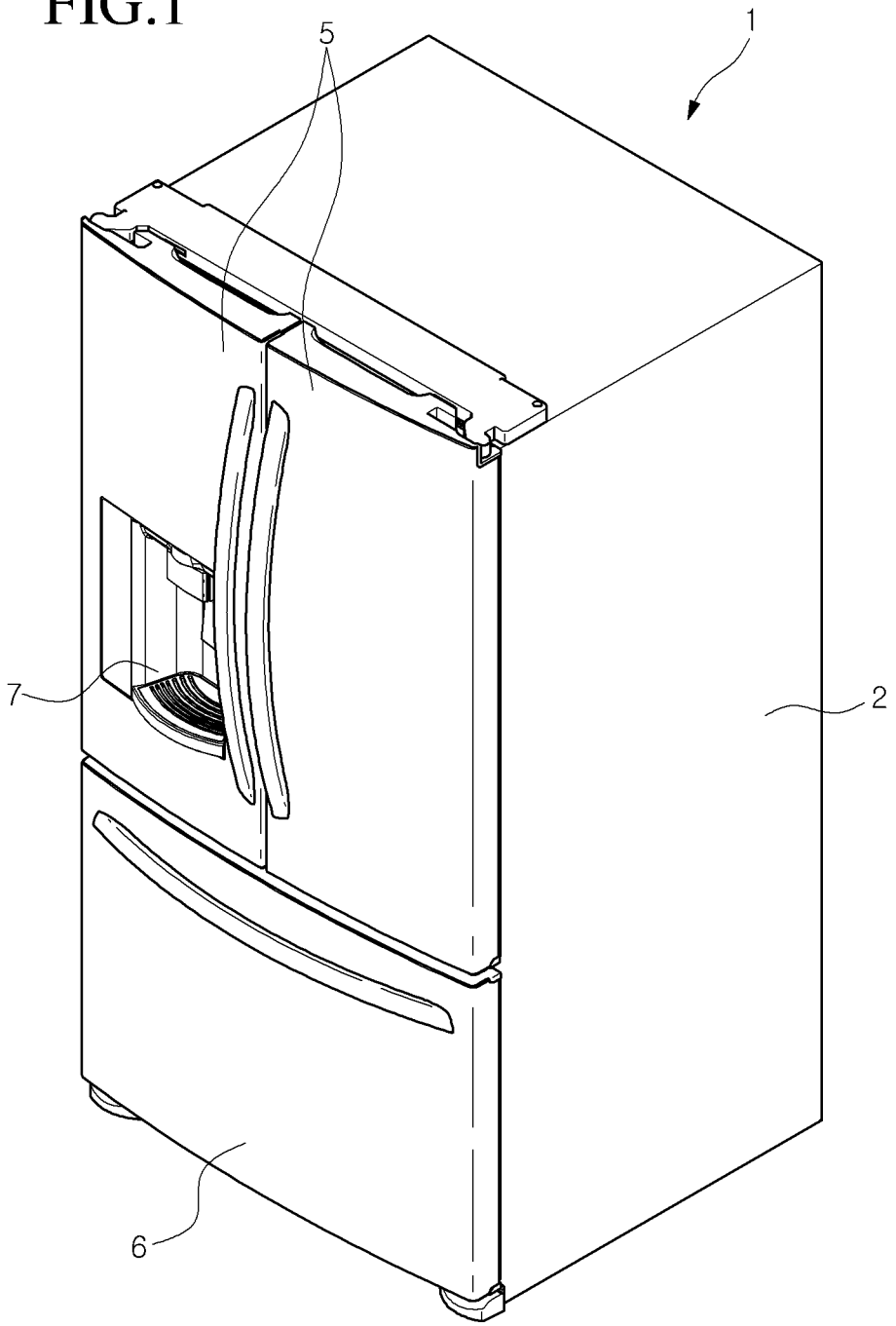
FIG. 1 is a perspective view of a refrigerator.
Figure 2:
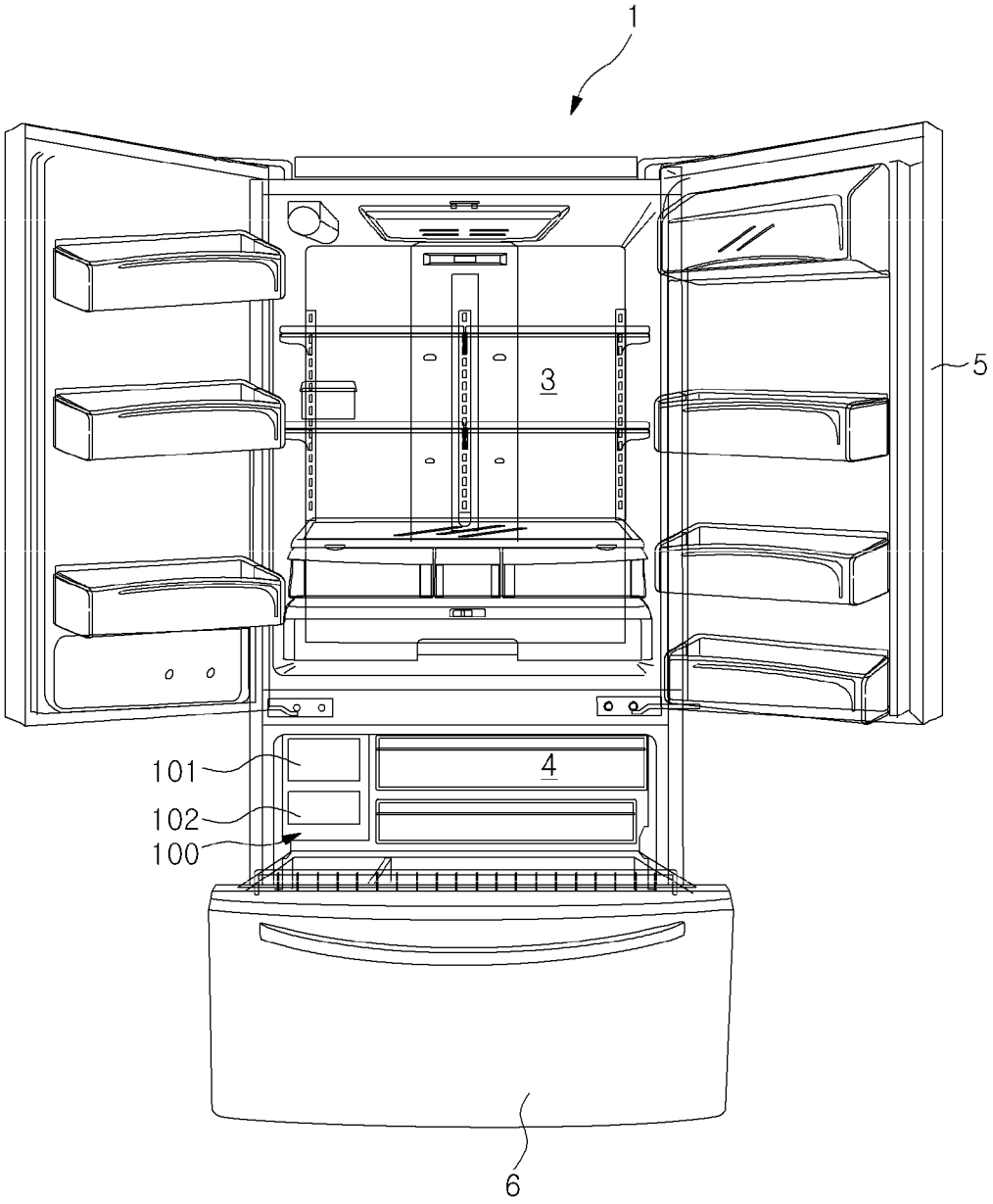
FIG. 2 is a view of the refrigerator in a state where a door is opened.

FIG. 1 illustrates a refrigerator. FIG. 2 illustrates the example refrigerator in a state where a door is opened.

Referring to FIGS. 1 and 2, a refrigerator 1 includes a cabinet 2 defining a storage space and doors for opening or closing the storage space. Here, an outer appearance of the refrigerator 1 may be defined by the cabinet 2 and the doors. Hereinafter, among various types of refrigerators, a bottom freezer-type refrigerator in which a freezing compartment is disposed under a refrigerating compartment and the refrigerating compartment is covered by a pair of rotatable doors (e.g., french doors) will be described as an example. However, the ice makers described throughout this disclosure are not limited to the bottom freezer-type refrigerator. For example, the ice makers described throughout this disclosure may be applied to various types of refrigerators.

In detail, the cabinet 2 has a storage space vertically partitioned by a barrier. That is, a refrigerating compartment 3 is defined at an upper side, and a freezing compartment 4 is defined at a lower side. Receiving members, such as a drawer, a shelf, a basket, and the like, may be provided within the refrigerating compartment 3 and the freezing compartment 4.

The doors include a refrigerating compartment door 5 for covering the refrigerating compartment 3 and a freezing compartment door 6 for covering the freezing compartment 4. The refrigerating compartment door 5 may be constituted by a pair of left and right doors. Thus, the pair of doors may be rotated to selectively open or close the refrigerating compartment 3. Also, the freezing compartment door 6 may be withdrawably provided in a drawer type configuration.

A dispenser 7 for dispensing purified water and/or made ice pieces to the outside may be disposed in the refrigerating compartment door 5. The dispenser 7 may communicate with an ice maker 100 (that will be described below) or a part for storing ice made in the ice maker 100 to dispense the made ice to the outside through the dispenser 7.

The ice maker 100 is provided in the freezing compartment 4. The ice maker 100 may make ice pieces using supplied water. Also, the ice maker 100 may make ice pieces having a globular or spherical shape. An ice bank 102 in which made ice pieces are separated from the ice maker 100 and then stored may be further disposed under the ice maker 100. The ice maker 100 and the ice bank 102 may be mounted inside the freezing compartment 4 in a state where the ice maker 100 and the ice bank 102 are received in a separate case 101.

Figure 3:
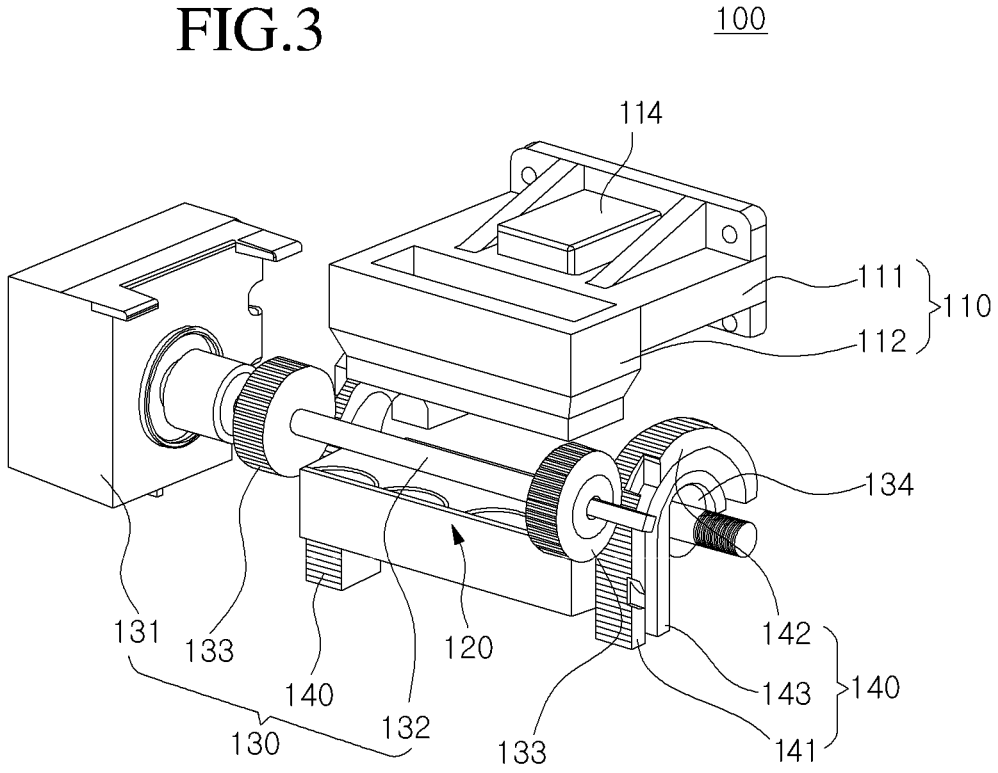
FIG. 3 is a perspective view of an ice maker.
Figure 4:
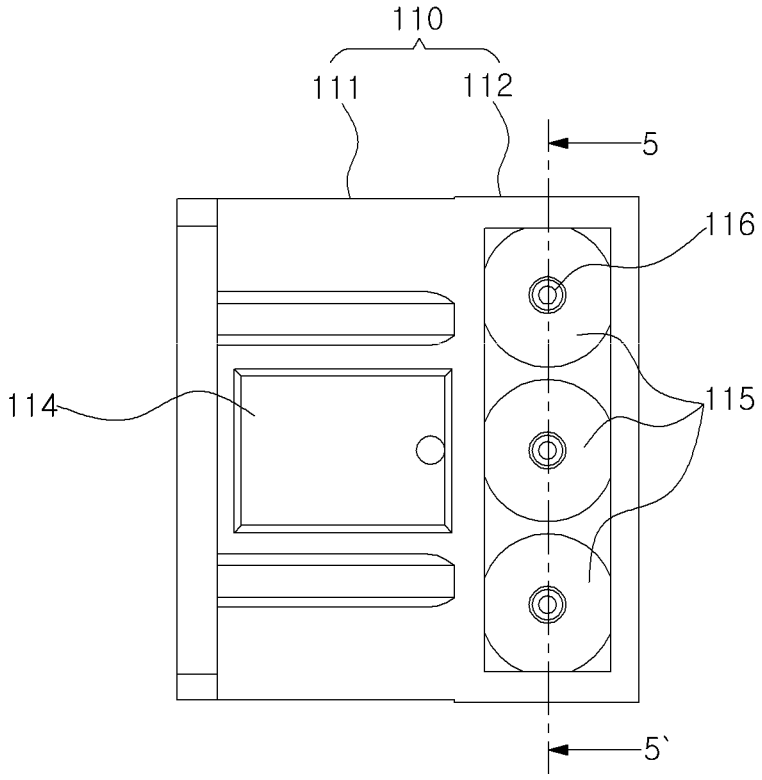
FIG. 4 is a plan view of an upper tray.
Figure 5:
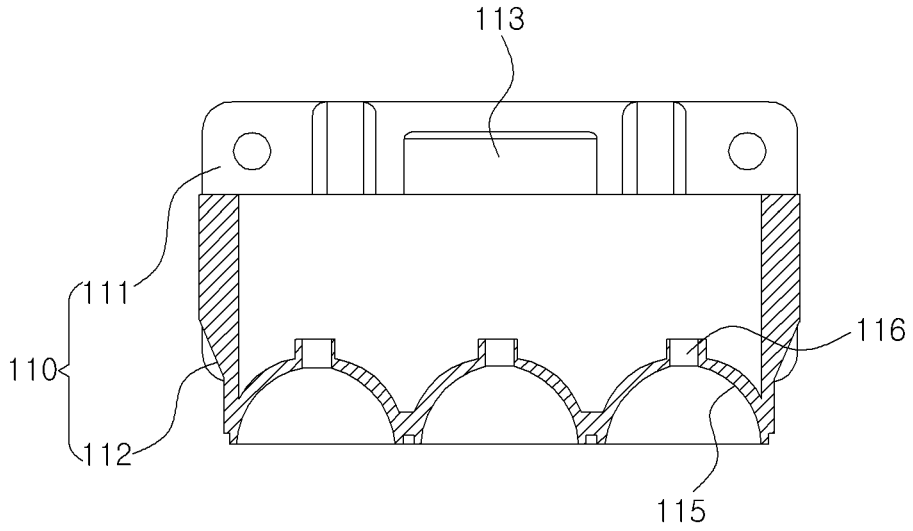
FIG. 5 is a cross-sectional view taken along line 5-5' of FIG. 4.
Figure 6:
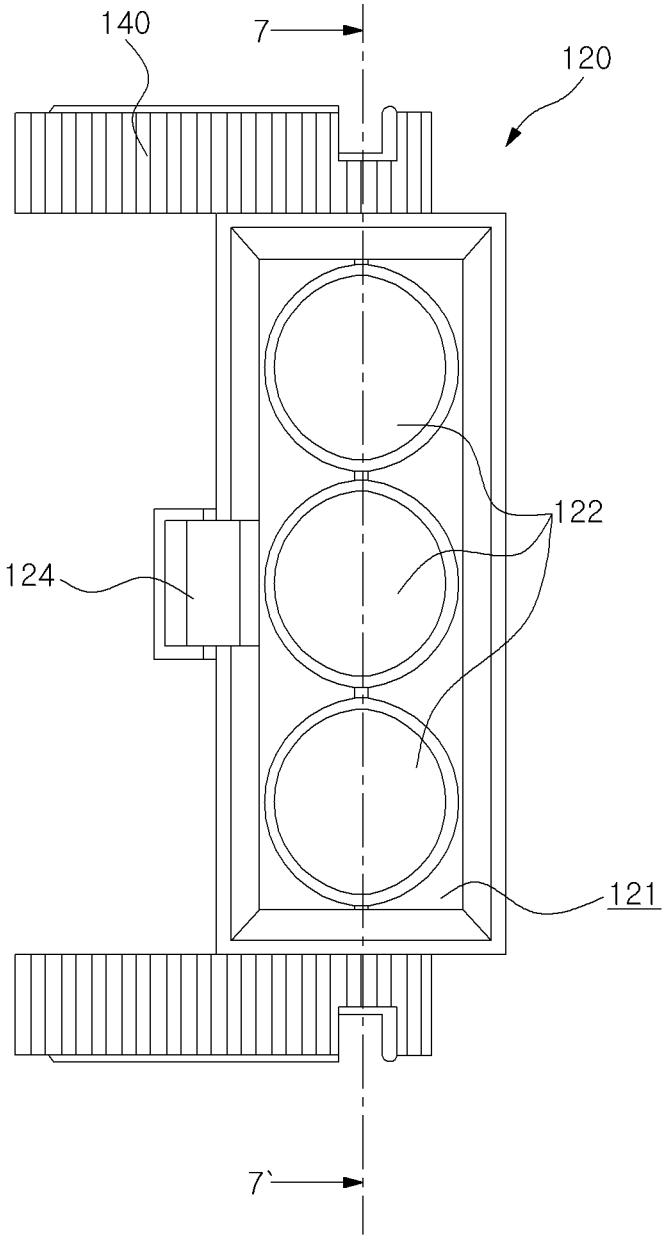
FIG. 6 is a plan view of a lower tray.
Figure 7:
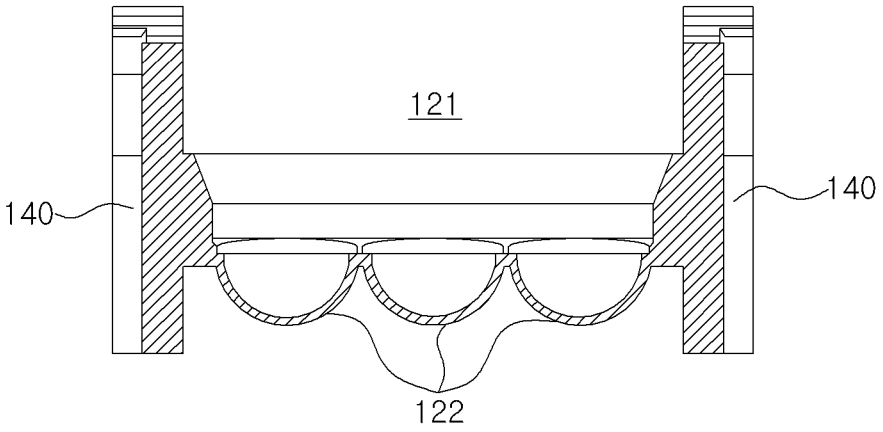
FIG. 7 is a cross-sectional view taken alone line 7-7' of FIG. 6.
Figure 8:
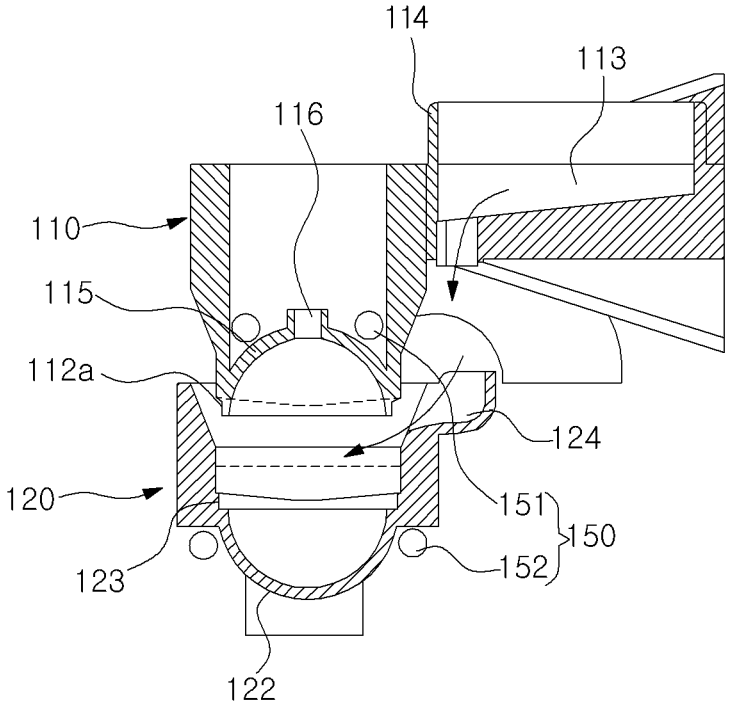
FIG. 8 is a side-sectional view of the ice maker in a state where the upper tray and the lower tray are coupled to each other.

FIG. 3 illustrates an example of the ice maker 100. FIG. 4 illustrates an example upper tray. FIG. 5 shows a cross-sectional view taken along line 5-5' of FIG. 4. FIG. 6 illustrates an example lower tray. FIG. 7 shows a cross-sectional view taken alone line 7-7' of FIG. 6. FIG. 8 illustrates the ice maker in a state where the upper tray and the lower tray are coupled to each other.

Referring to FIGS. 3 to 8, an ice maker 100 includes a tray providing a space in which water is supplied to make ice pieces, a driving unit 130 for opening or closing the tray, and ejecting units 150 for separating the ice pieces made in the tray. The tray includes an upper tray 110 defining an upper appearance and a lower tray 120 defining a lower appearance.

In more detail, the upper tray 110 may be formed of a metal material having superior thermal conductivity, such as aluminum. Also, the upper tray 110 may include a fixed part 111 fixed to a side of the inside of the freezing compartment 4 and an insertion tray part 112 having an upper shell 115 that defines an upper half portion of a globular or spherical ice piece.

The fixed part 111 may be mounted on a wall of the freezing compartment 4 or a side surface of the case 101 of the ice maker 100. Also, a water supply part 114 having a water supply passage 113 which supplies water for making ice pieces into the lower tray 120 is provided in the fixed part 111. The water supply part 114 is disposed to communicate with a water supply guide part 124 provided in the lower tray 120. Thus, water supplied through the water supply passage 113 is supplied into the water supply guide part 124 of the lower tray 120.

The insertion tray part 112 has a square shape when viewed from an upper side and extends in a vertical direction. The insertion tray part 112 has an opened top surface. The upper shell 115 is disposed in a bottom surface of the insertion tray part 112.

Also, a lower portion of an outer surface of the insertion tray part 112 may have a shape corresponding to a tray receiving part 123 that will be described in more detail below. That is, the lower portion of the insertion tray part 112 may have a shape which extends vertically from a lower end of the fixed part 111 by a predetermined length and then is inclined in a direction in which the insertion tray part 112 has a width that gradually decreases downward.

The upper shell 115 has a hemispherical shape. The upper shell 115 is coupled to a lower shell 122 defined in the lower tray 120 to match each other to define a globular or spherical shell for making a globular or spherical ice piece. Thus, the upper shell 115 may make an upper half portion of an ice piece.

Also, the upper shell 115 may be provided in plurality. Here, the plurality of upper shells 115 may be successively arranged in one line or a plurality of rows. An air hole 116 may be defined in an upper end of the upper shell 115. Thus, when water is supplied in a state where the upper shell 115 and the lower shell 122 are coupled to each other, air within the globular or spherical shell may be exhausted to the outside.

The lower tray 120 may be disposed under the upper tray 110. The lower tray 120 may be formed of the same metal material as the upper tray 110. A recessed part 121, in which water for making an ice is filled and the upper shell 115 is received, is defined in the lower tray 120.

Also, rack gears 140 for vertically moving and rotating the lower tray 120 are disposed on both left and right sides of the lower tray 120. Thus, the lower tray 120 is vertically movably and rotatably disposed with respect to the upper tray 110.

A hemispherical lower shell 122 recessed in a hemispherical shape is defined in a lower end of the recessed part 121. A globular or spherical shell is defined based on the upper shell 115 becoming closely attached to an upper end of the lower shell 122. The lower shell 122 may be disposed symmetrical to the upper shell 115.

The tray receiving part 123 in which the insertion tray part 112 of the upper tray 110 is inserted is defined in the recessed part 121. When the lower tray 120 is moved upward and closely attached to the upper tray 110, the insertion tray part 112 is inserted into the tray receiving part 123. Thus, the upper shell 115 and the lower shell 122 may be coupled to match each other in position.

The water supply guide part 124 is disposed in a central portion of the tray receiving part 123. The water supply guide part 124 may be a part for guiding water supplied through the water supply part 114 of the upper tray 110. The water supply guide part 124 protrudes backwardly from an outer surface of an upper side of the recessed part 121 and is disposed at a center of a back surface of an upper portion of the lower tray 120. Thus, water introduced into the water supply guide part 124 is guided into the recessed part 121 and then spread in left and right directions. As a result, the water may be filled into the lower shell 122.

Here, water supplied into the recessed part 121 may be filled with a water level higher than an upper surface of the lower shell 122. That is, the water may be supplied so that the water does not overflow from the inside of the globular or spherical shell, which is defined when the upper tray 110 is closed, through the air hole 116. An amount of supplied water may be adjusted to correspond to a water level slightly lower than an upper end of the globular or spherical shell in consideration of the volume expansion of water occurring when the water is frozen.

Also, the ejecting units 150 for separating the made ice pieces from the trays may be further disposed on the upper tray 110 and the lower tray 120. The ejecting units 150 include an upper heater 151 disposed on an outer surface of the upper tray 110 and a lower heater 152 disposed on an outer surface of the lower tray 120. Specifically, the upper heater 151 and the lower heater 152 are mounted on outer surfaces of the upper shell 115 and the lower shell 122, respectively.

The driving unit 130 for vertically moving and rotating the lower tray 120 is provided in the ice maker 100. The driving unit 130 includes a motor 131 for generating a rotation power, a driving shaft 132 connected to a rotation shaft of the motor 131, a pair of pinion gears 133 fitted into the driving shaft 132, and the rack gears 140 linked with the pinion gears 133. The rack gears 140 may be mounted on both side surfaces of the lower tray 120, respectively. Each of the rack gears 140 may be integrally manufactured when the lower tray 120 is manufactured. Alternatively, the rack gears 140 may be separately manufactured and then mounted on both left and right sides of the lower tray 120.

Also, the pinion gears 133 are disposed at front sides of the rack gears disposed on both left and right sides and then gear-coupled to the rack gears 140, respectively. The pinion gears 133 may be connected to the driving shaft 132 and rotated together with the motor 131.

The rack gear 140 includes a vertical part 141 extending in a vertical direction and a rotation part 142 rounded with a predetermined curvature from an upper end of the vertical part 141. Gear teeth engaged with the pinion gear 133 are disposed on an outer surface of the rack gear 140.

In detail, the vertical part 141 may have a predetermined length in the vertical direction to guide a vertical movement of the lower tray 120. Thus, when the pinion gear 133 is disposed on a lower end of the vertical part 141, the lower tray 120 is disposed on the uppermost position thereof and thus closely attached to the upper tray 110. Also, when the pinion gear 133 is disposed on an upper end of the vertical part 141, the lower tray 120 is disposed at a point furthest downward from the upper tray 110.

Also, the rotation part 142 may be rounded in a semicircular or fan shape on the upper end of the vertical part 141. Also, the rotation part 142 may have the same width as the vertical part 141. Thus, when the pinion gear 133 is further rotated in a state where the pinion gear 133 is disposed on the upper end of the vertical part 141, the pinion gear 133 is moved along the rotation part 142. As a result, the lower tray 120 is rotated.

Figure 9:
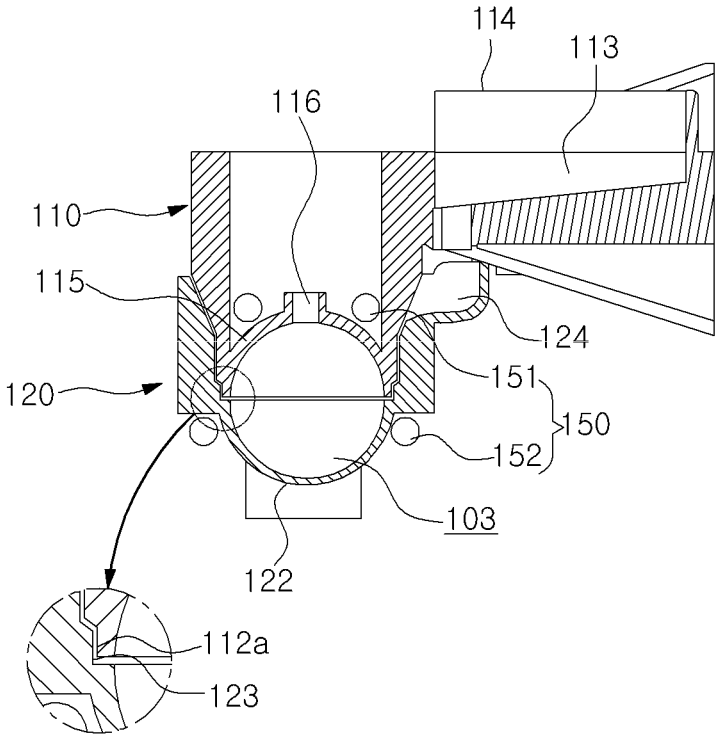
FIG. 9 is a side cross-sectional view of the ice maker in a state where water is supplied.

FIG. 9 shows a side cross-sectional view of the ice maker in a state where water is supplied.

First, referring to FIG. 8, the lower tray 120 is moved downward to supply water for making ices in a state where the lower tray 120 is spaced from the upper tray 110. Here, the supplied water is supplied so that the lower shell 122 overflows with the supplied water. Thus, an amount of supplied water may be less than a volume of the globular or spherical shell 103 in consideration of the volume expansion during the ice making process. Also, when the upper tray 110 is inserted into the lower tray 120, the water filled into the upper end of the lower shell 122 may flow into the upper shell 115.

Referring to FIG. 9, when the lower tray 120 and the upper tray 110 are closely attached to each other, the upper shell 115 and the lower shell 122 are closely attached to each other. In this arrangement, water may be filled up to the inside of the upper shell 115 without leaking.

In detail, a stepped portion 112*a* is disposed on a lower end of the upper tray 110, for instance, a lower end of the insertion tray part 112. The stepped portion 112*a* is closely seated on the tray receiving part 123 of the recessed part 121.

Hereinafter, an operation of the ice maker including the above-described parts will be described.

FIGS. 10 to 13 show views successively illustrating an operation of the ice maker.

Referring to FIGS. 10 to 13 (see also FIG. 1), a guide groove 143 for guiding the movement of the lower tray 120 is defined in the rack gear 140. Also, a guide protrusion 144 is disposed on a side surface of the case 101 of the ice maker 100 or a side surface of the freezing compartment 4 which corresponds to the guide groove 143.

In detail, the guide protrusion 144 is received inside the guide groove 143. When the lower tray 120 is moved, the guide protrusion 144 may guide the lower tray 120 so that the lower tray 120 is moved only along a preset path. For example, three guide protrusions 144 may be provided. Here, the three guide protrusions 144 may be vertically disposed at the same distance as each other to guide the vertical movement and rotation of the lower tray 120. The present example is not limited to the number of guide protrusions 144 and more or fewer guide protrusions 144 may be used.

A side surface of the rack gear 140 may be recessed to define the guide groove 143. Also, the guide groove 143 includes a first guide groove 143*a* defined along the vertical part 141, a second guide groove 143*b* defined along the rotation part 142, and a third guide groove 143*c* branched from a side of the first guide groove 143 to extend in the outside direction.

A guide roller 134 (see also FIG. 1) is further disposed on a side of the rack gear 140. The guide roller 134 is included in the driving unit 130, and smoothly moves the rack gear 140. Specifically, the guide roller 134 is closely attached to a lower surface of the rotation part 142 to serve as a rotation shaft of the rack gear 140. The guide roller 134 may be rotatably mounted on the wall of the freezing compartment 4 or a side surface of the case 101. Also, the guide roller 134 may have a shape corresponding to that of the inside of the rotation part 142.

Figure 10:
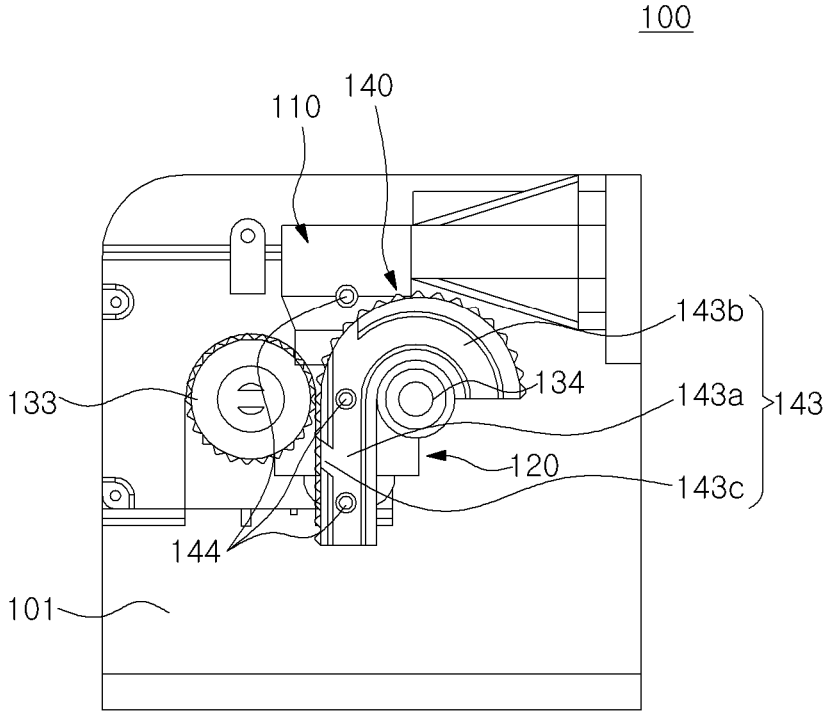
FIGS. 10 to 13 are views successively illustrating an operation of the ice maker.

To make ice in the ice maker 100, as shown in FIG. 10, the lower tray 120 may be moved into the lowermost position. Here, the pinion gear 133 is disposed on an upper end of the vertical part of the rack gear 140. In this state, the lower tray 120 and the upper tray 110 may be spaced from each other. Also, as shown in FIG. 8, the water supply may be enabled. The water supplied into the water supply guide part 124 is filled into the lower shell 122. Also, the water may be supplied in an amount enough to make a globular or spherical ice piece.

Figure 11:
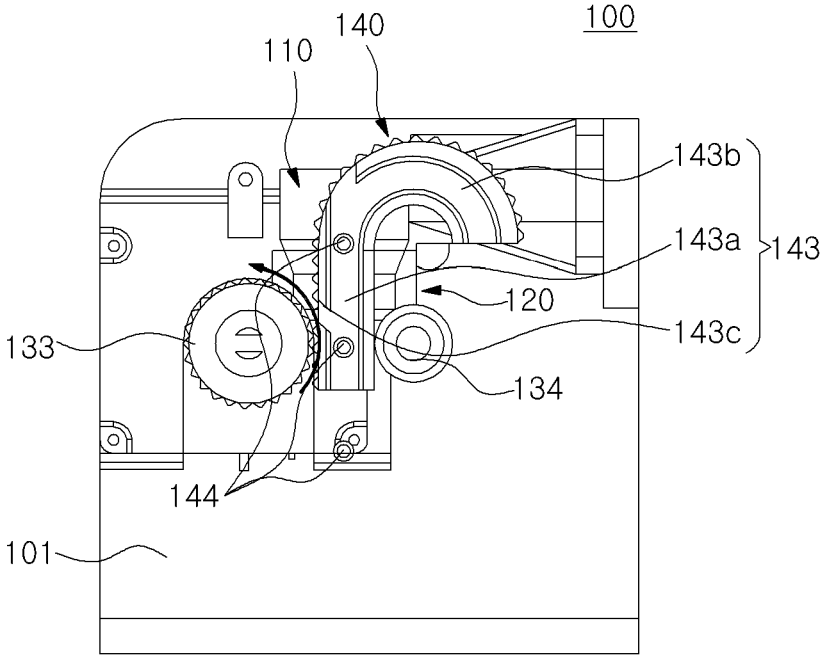

When the water is completely supplied into the lower tray 120, the pinion gear 133 is rotated in a counterclockwise direction by the operation of the motor 131 to move the rack gear 140 upward. Thus, the lower tray 120 coupled to the rack gear 140 is moved upward. Also, the lower tray 120 is moved upward by the operation of the driving unit 130 to closely attach the upper tray 110 and the lower tray 120 to each other. When the upper tray 110 and the lower tray 120 are closely attached to each other, the operation of the motor 131 is stopped. Thus, as shown in FIG. 11, the pinion gear 133 is located on the lower end of the vertical part 141 of the rack gear 140.

In this state, the upper shell 115 and the lower shell 122 are coupled to each other. Also, a sufficient amount of water for making ice pieces may be filled into the globular or spherical shell 103. Also, cool air may be continuously supplied to make a globular or spherical ice piece within the globular or spherical shell 103.

After a predetermined time elapses, the lower heater 152 disposed on the lower tray 120 is operated so as to separate ice pieces. When the lower tray 120 is heated by the lower heater 152, a surface of a lower portion of the made ice is melted.

Figure 12:
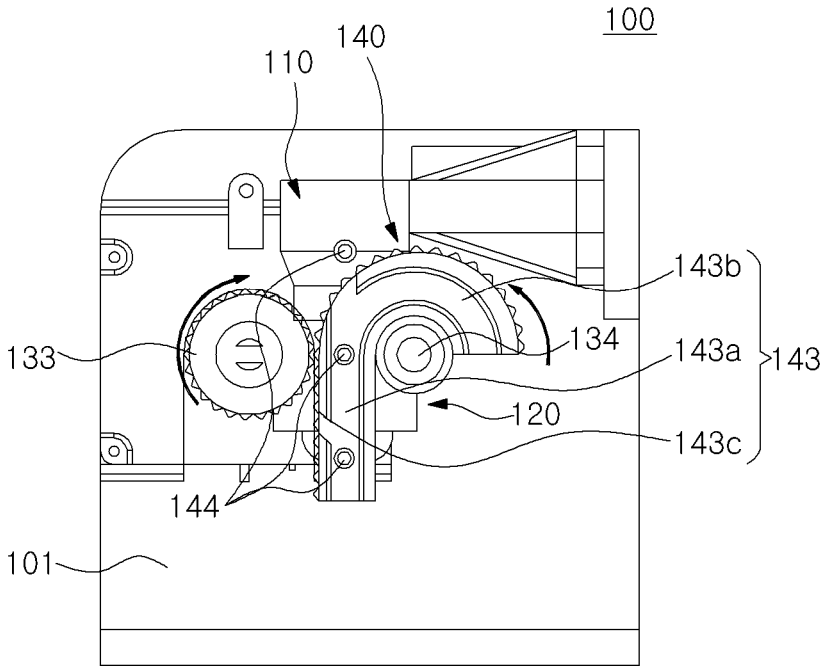

In this state, the pinion gear 133 is rotated in a clockwise direction by the rotation of the motor 131, and thus, the rack gear 140 is moved downward. Also, as shown in FIG. 12, the pinion gear 133 is rotated until the pinion gear 133 is disposed at the upper end of the vertical part 141 of the rack gear 140. At this point, the lower tray 120 may be in a state in which the lower tray 120 is moved into the lowermost position, and in a state in which the made ice piece is attached to the upper tray 110.

As described above, the guide protrusion 144 is moved in the vertical direction along the first guide groove 143*a* only when the lower tray 120 is vertically moved. Thus, the lower tray 120 may be stably moved in the vertical direction by the guide of the guide protrusion 144 and the first guide groove 143*a*.

When the motor 131 is further rotated in the state of FIG. 12, the pinion gear 133 is further rotated in the clockwise direction. Thus, as the pinion gear 133 is rotated, the rack gear 140 is engaged with the rotation part 142 over the vertical part 141. Thus, the rack gear 140 is rotated in the counterclockwise direction, and also, the lower tray 120 is rotated in the counterclockwise direction.

Figure 13:
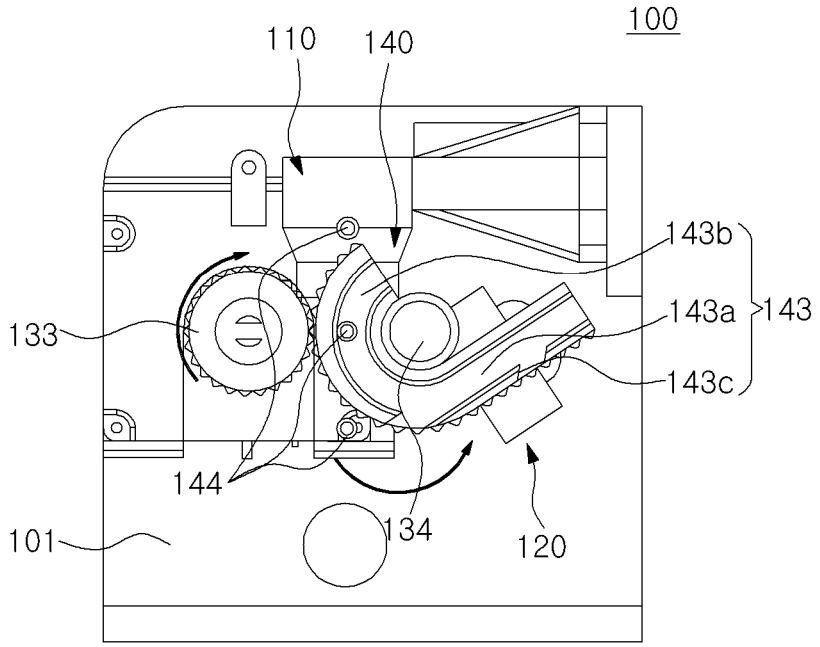

When the rack gear 140 is rotated by the rotation of the pinion gear 133, the rack gear 140 is in a state of FIG. 13. In this state, the lower tray 120 is moved in a rear direction of the upper tray 110 by the rotation of the rack gear 140 to completely open a lower space of the upper tray 110.

Also, water remaining in the lower shell 122 of the lower tray 120 may be discharged, which reduces the likelihood of ice pieces dropping from the upper tray 110 from interfering with the water. The made ice pieces attached to the upper tray 110 may drop by heat of the upper heater 151 disposed on the upper tray 110. In detail, when the upper heater 151 is operated in the state of FIG. 13, the upper tray 110 is heated to melt a surface of the made ice contacting the upper shell 115. When the surface of the ice is melted, the ice drops down by a self-weight thereof. Thus, the ice may be separated from the tray and stored in the ice bank 102.

After the ice is completely separated, the driving unit 130 is reversely moved. Thus, the lower tray 120 is disposed directly below the upper tray 110 as shown in FIG. 12, and the water supply for making ice pieces may be performed. Then, the above-described processes may be repeatedly performed. Here, a separate unit may be further provided to block the remaining water from dropping into the ice bank 101 when the lower tray 120 is rotated. For example, a separate remaining water guide plate may be disposed above the ice bank 102 to block the remaining water from dropping into the ice bank 102. Also, the remaining water guide plate may be separated from the dropping path of the ice just before the upper heater 151 is operated.

According to another example, an ejecting unit may be disposed above an upper tray. Here, the ejecting unit may be operated by being linked with an operation of a driving unit to separate an ice downward.

Thus, other components except for the ejecting unit and a coupling relationship between the ejecting unit and the driving unit may be the same as those of the ice maker described above. Thus, the same components will be indicated by the same reference numerals, and their above detailed description will be referenced, rather than repeated. Also, reference numerals which are not shown may be referred to as the same reference numeral as those of the above ice maker.

Figure 14:
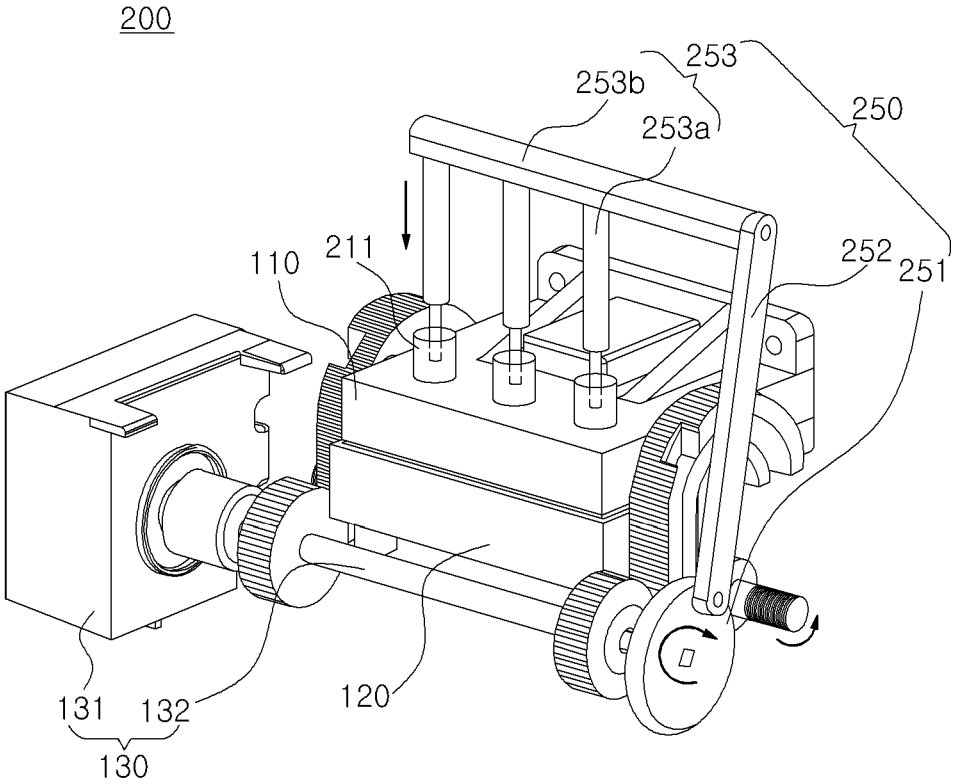
FIGS. 14 to 16 are exploded perspective views illustrating an ice separation process of an ice maker.
Figure 15:
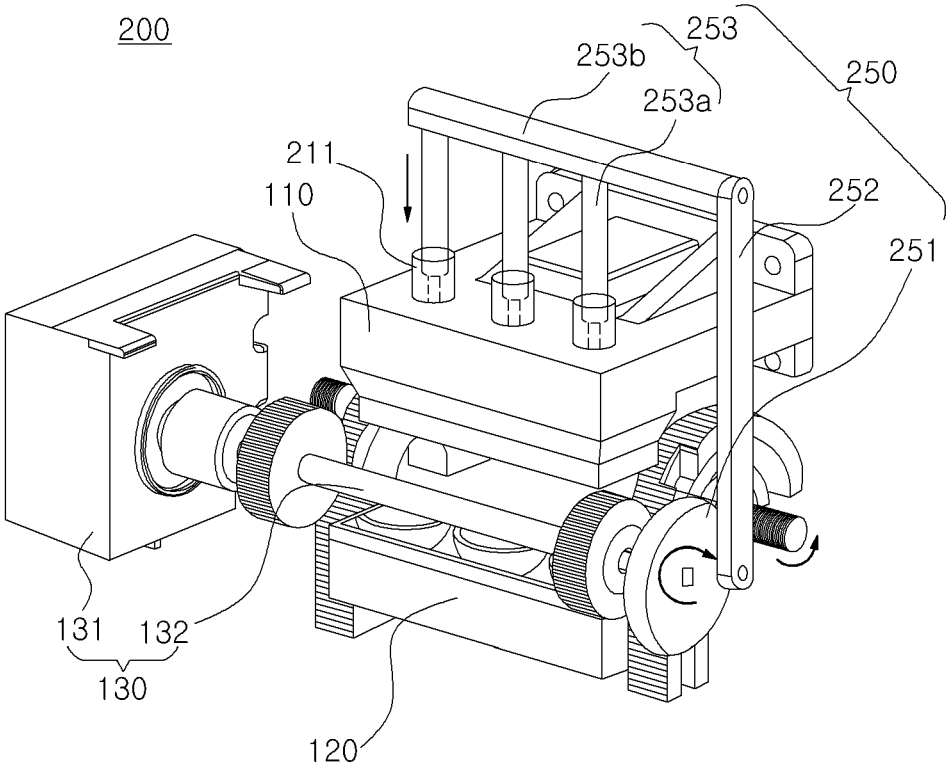
Figure 16:
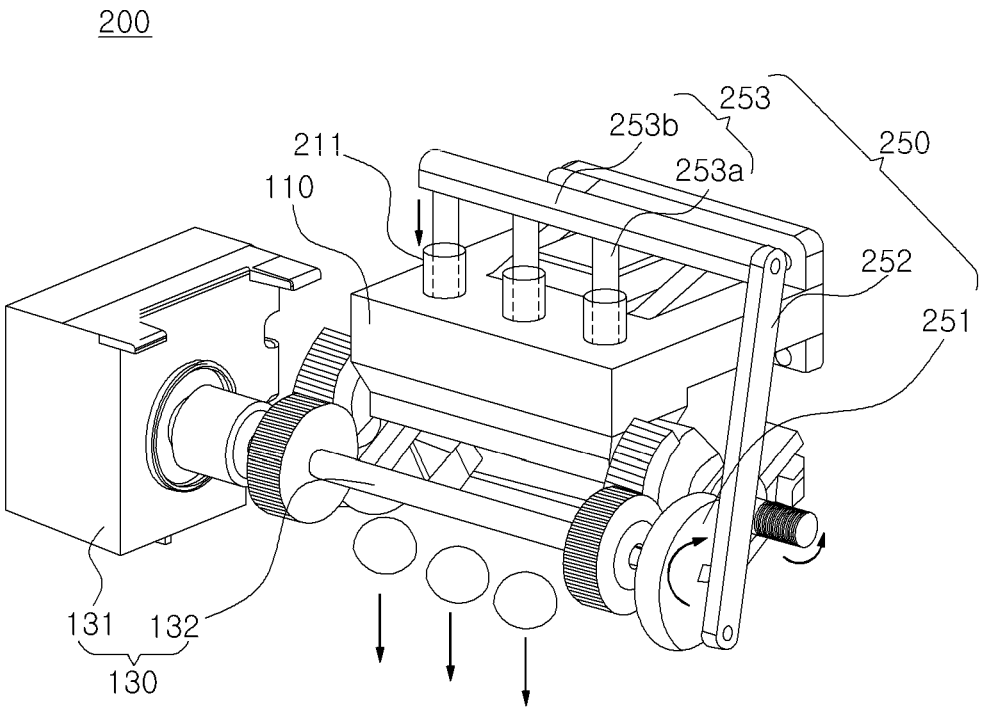

FIGS. 14 to 16 illustrate an example ice separation process of an example ice maker.

Referring to FIGS. 14 to 16, an ice maker 200 includes an upper tray 110 including an upper shell 115, a lower tray including a lower shell 115 coupled to the upper shell 115 of the upper tray 110 to define a globular or spherical shell 103, a driving unit 130 for vertically moving and rotating the lower tray 120, and an ejecting unit 250 for separating a made ice piece to the outside of a tray assembly. Also, the ejecting unit 250 includes a disk 251, a rod 252, and an ejector 253.

In detail, the disk 252 has a circular plate shape and is coupled to a driving shaft 132 rotated by a motor 131. The rod 252 converts a rotation movement of the disk 251 into a linear movement of the ejector 253. Also, the rod 252 has a predetermined length. Both ends of the rod 252 are shaft-coupled to the disk 251 and the ejector 253, respectively. Here, a side of the rod 252 may be disposed on a position eccentrical to a rotation center of the disk 251.

The ejector 253 is disposed above the upper tray 110 and shaft-coupled to an upper end of the rod 252. Thus, the ejector 253 may be vertically moved according to an operation of the driving unit 130. The ejector 253 includes ejecting pins 253*a* having numbers corresponding to the number of upper cells 115 disposed on the upper tray 110 and a connection member 253*b* connecting the plurality of ejecting pins 253*a* to each other to allow the plurality of ejecting pins 253*a* to be moved as one module. Also, the rod 252 has an upper end rotatably connected to an end of the connection member 253*b*.

The ejecting pins 253*a* are mounted to pass through an upper portion of the upper tray 110. Also, each of the ejecting pins 253*a* may be vertically moved by an ejector guide 211 disposed on a top surface of the upper tray 110. The ejector guide 211 has a cylindrical shape and extends by a predetermined length. The ejecting pin 253*a* may be vertically moved in a state where the ejecting pin 253*a* is inserted into the ejector guide 211.

A portion of the ejecting pin 253*a* passes through an air hole 116 defined in the upper shell 115 of the upper tray 110 to push an ice within the upper shell 115 downward. At least portion of the upper shell 115 may be formed of an elastic member. Alternatively, a lower end of the ejecting pin 253*a* may push the upper shell 115 from an upper side to separate an ice within the upper shell 115.

Hereinafter, an example ice separation process of the ice maker 200 will be described.

After water for making ice is supplied into the lower tray 120, the lower tray 120 is moved upward. As a result, the lower tray 120 is closely attached to the upper tray 110 as shown in FIG. 14. In this state, cool air is supplied to make ice. Here, the ejector 253 is disposed in the uppermost position thereof, and thus, a lower end of the ejecting pin 253*a* is disposed outside an upper portion of the upper shell 115.

When the ice making process is finished in this state, a lower heater 152 is operated to melt a lower surface of ice attached to the lower shell 122, thereby separating the ice from the lower tray 120. In this state, the lower tray 120 is moved downward by the operation of the driving unit 130 to become in a state of FIG. 15. After the lower tray 120 is completely moved downward, the lower tray 120 is rotated as shown in FIG. 16 to open a lower side of the upper tray 110. Here, an ice piece is attached to the upper shell 115 of the upper tray 110.

As the lower tray 120 is moved downward, the disk 251 connected to the driving shaft 132 also is rotated. Thus, as the disk 251 is rotated, the rod 252 is vertically moved to move the ejector 253 downward in an order of FIG. 15 and FIG. 16.

In the state of FIG. 16 in which the lower tray 120 is completely rotated, the lower end of the ejecting pin 253*a* passes through the upper shell 115 to push an ice piece within the upper shell 115 downward. Thus, the made ice pieces may be forcibly separated from the upper tray 110 and transferred downward. When compared to the ejecting unit including the upper and lower heaters described with respect to FIGS. 3 to 13, the ejecting unit shown in FIGS. 14 to 16 includes the lower heater and the ejector. In some implementations, the ejecting unit of the ice maker 200 may include an upper heater, as well.

According to yet another example, an ejecting unit may be disposed above an upper tray. Also, the ejecting unit may be linked with a driving unit to separate made ice pieces using a rack and pinion.

Thus, other components except for the ejecting unit and a coupling relationship between the ejecting unit and the driving unit may be the same as those of the ice maker described above. Thus, the same components will be indicated by the same reference numerals, and their above detailed description will be referenced, rather than repeated. Also, reference numerals which are not shown may be referred to as the same reference numeral as those of the above ice maker.

Figure 17:
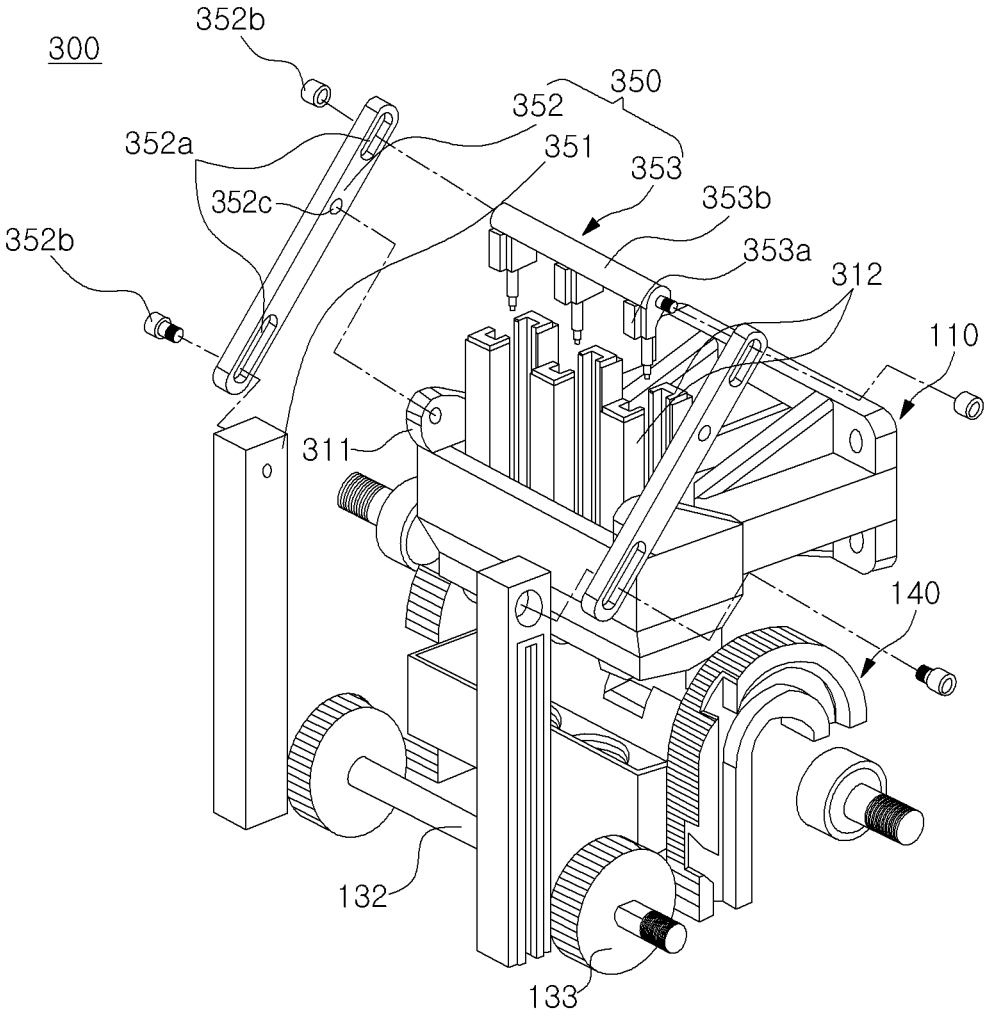
FIG. 17 is an exploded perspective view of an ice maker.
Figure 18:
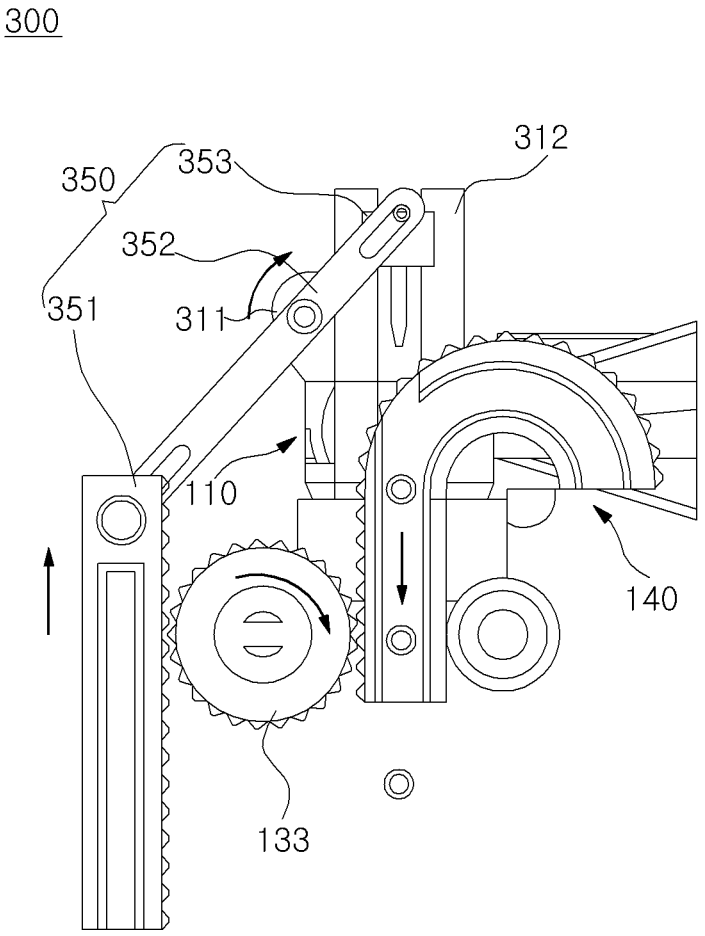
FIGS. 18 to 20 are views successively illustrating an ice separation process in the ice maker.
Figure 19:
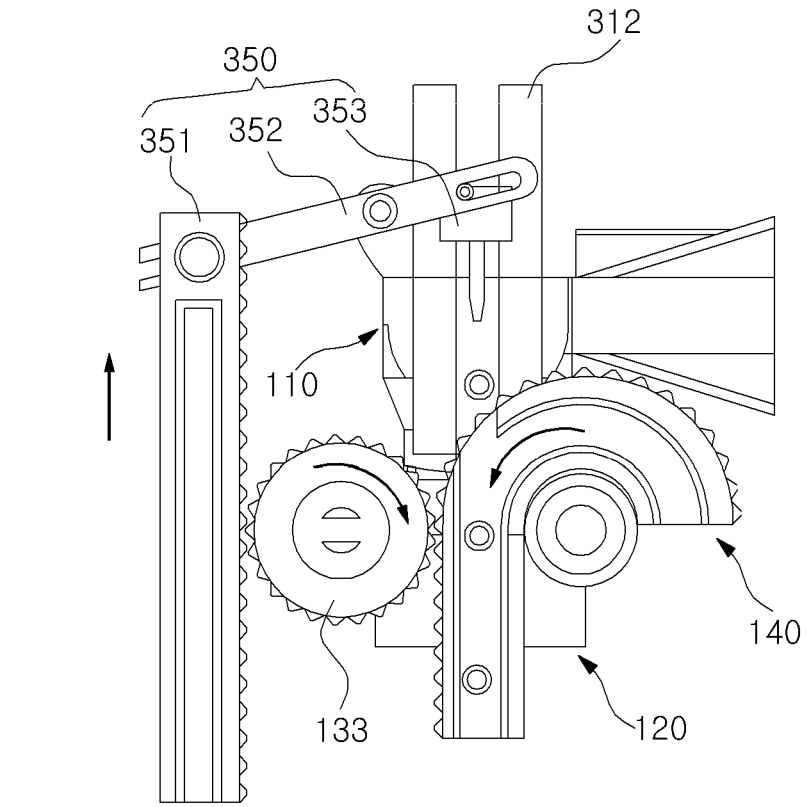
Figure 20:
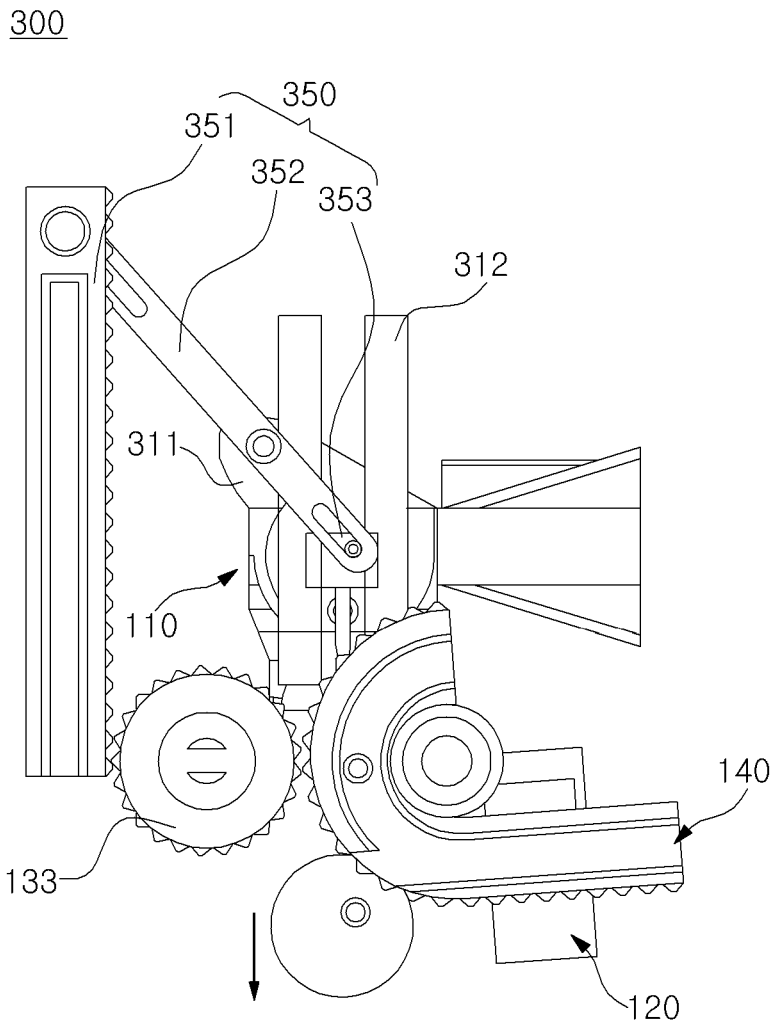

FIG. 17 illustrates an example ice maker according. FIGS. 18 to 20 show views successively illustrating an example ice separation process in the example ice maker.

Referring to FIGS. 17 to 20, an ice maker 300 includes an upper tray 110 including an upper shell 115, a lower tray 120 including a lower shell 122, a driving unit 130 for vertically moving and rotating the lower tray 120, and an ejecting unit 350 for separating made ice pieces to the outside of a tray member. Also, the ejecting unit 350 includes an ejecting rack gear 351, an ejector 353, and a link 352.

In detail, a pinion gear 133 for operating a rack gear 140 is disposed on a driving shaft 132 connected to a motor 131. The ejecting rack gear 351 is disposed on a front side facing the rack gear 140. The ejecting rack gear 351 is disposed in a vertical direction. Also, the ejecting rack gear 351 may be provided in a pair on both left and right sides. The ejecting rack gear 351 is gear-coupled to the pinion gear 133 and thus vertically movable. Thus, the ejecting rack gear 351 and the rack gear 140 are respectively disposed on front and rear sides with the pinion gear 133 therebetween. Each of the ejecting rack gear 351 and the rack gear 140 is gear-coupled to the pinion gear 133. Thus, when the pinion gear 133 is rotated, the ejecting rack gear 351 and the rack gear 140 may be linked with the pinion gear 133.

Any portion 352*c* of the link 352 is rotatably coupled to a link mounting part 311 disposed on a top surface of the upper tray 110 by a coupling member. Also, the link 352 has both ends respectively coupled to the ejecting rack gear 351 and the ejector 353. Thus, the link 352 is rotated with respect to the link mounting part 311 according to the vertical movement of the ejecting rack gear 351 to vertically move the ejector 353. Also, a long hole 352*a* is defined in each of both ends of the link 352. The ejecting rack gear 351 and the ejector 353 are connected to each other by a coupling member 352*b* passing through the long hole 352*a*. Thus, the link 352 may be smoothly rotated.

The ejector 353 may be disposed above the upper tray 110 to push a made ice piece within the upper shell 115, thereby separating the ice. The ejector 353 may be mounted on an ejector guide 312 disposed on the top surface of the upper tray 110. The ejector guides 312 are spaced from each other in front and rear directions and extend in a vertical direction. Also, the ejector guides 312 are disposed with the ejector 353 therebetween to guide the vertical movement of the ejector 353.

The ejector 353 includes ejecting pins 353*a* having numbers corresponding to the number of upper shells 115 and a connection part 353*b* connecting upper ends of the ejecting pins 353*a* to each other. A lower portion of each of the ejecting pins 353*a* may have a diameter and length enough to pass through an air hole 116 of the upper shell 115. If the upper shell 115 is formed of an elastically deformable material, the ejecting pin 353*a* may push the upper shell 115 from an upper side of the upper shell 115 without passing through the upper shell 115 to separate an ice piece. In this case, the air hole may have a diameter less than that of a lower end of the ejecting pin 353*a*.

Hereinafter, an example ice separation process of the ice maker 300 will be described.

After water for making ices is supplied into the lower tray 120, the lower tray 120 is moved upward. As a result, the lower tray 120 is closely attached to the upper tray 110 as shown in FIG. 18. In this state, cool air is supplied to make ice. Here, the ejector 353 is disposed on the uppermost position thereof, and thus, the lower end of the ejecting pin 353*a* is disposed outside an upper portion of the upper shell 115.

When the ice making process is finished in this state, a lower heater 152 is operated to melt a lower surface of ice attached to the lower shell 122, thereby separating the ice from the lower tray 120. In this state, the lower tray 120 is moved downward by the operation of the driving unit 130 to become in a state of FIG. 19. Also, after the lower tray 120 is completely moved downward, the lower tray 120 is rotated as shown in FIG. 20 to open a lower side of the upper tray 110. Here, an ice is attached to the upper shell 115 of the upper tray 110.

As the lower tray 120 is moved downward, the ejecting rack gear 351 linked by the pinion gear 133 may be moved upward also. That is, in the state of FIG. 18, when the pinion gear 133 is rotated in a clockwise direction, the rack gear 140 is moved downward and the ejecting rack gear 351 is moved upward to become in a state of FIG. 19. In this state, the ejector 353 is moved somewhat downward, but does not contact an ice piece formed within the globular or spherical shell 103.

In this state, when the pinion gear 133 is further rotated in the clockwise direction to become in a state of FIG. 20, the rack gear 140 is rotated to open a lower side of the upper tray 110. Then, the ejecting rack gear 351 is further moved upward to further rotate the link 352 in the clockwise direction, thereby further moving the ejector 353 downward.

In the state of FIG. 20 in which the lower tray 120 is completely rotated, the lower end of the ejecting pin 353*a* passes through the upper shell 115 to push an ice piece within the upper shell 115 downward. Thus, the made ice pieces may be forcibly separated from the upper tray 110 and transferred downward.

According to another example, an ejecting unit may be disposed above an upper tray. Here, the ejecting unit may be linked with an operation of a driving unit and operated in a cam driving manner to separate an ice piece downward.

Thus, other components except for the ejecting unit and a coupling relationship between the ejecting unit and the driving unit may be the same as those of the ice maker described above. Thus, the same components will be indicated by the same reference numerals, and their above detailed description will be referenced, rather than repeated. Also, reference numerals which are not shown may be referred to as the same reference numeral as those of the above ice maker.

Figure 21:
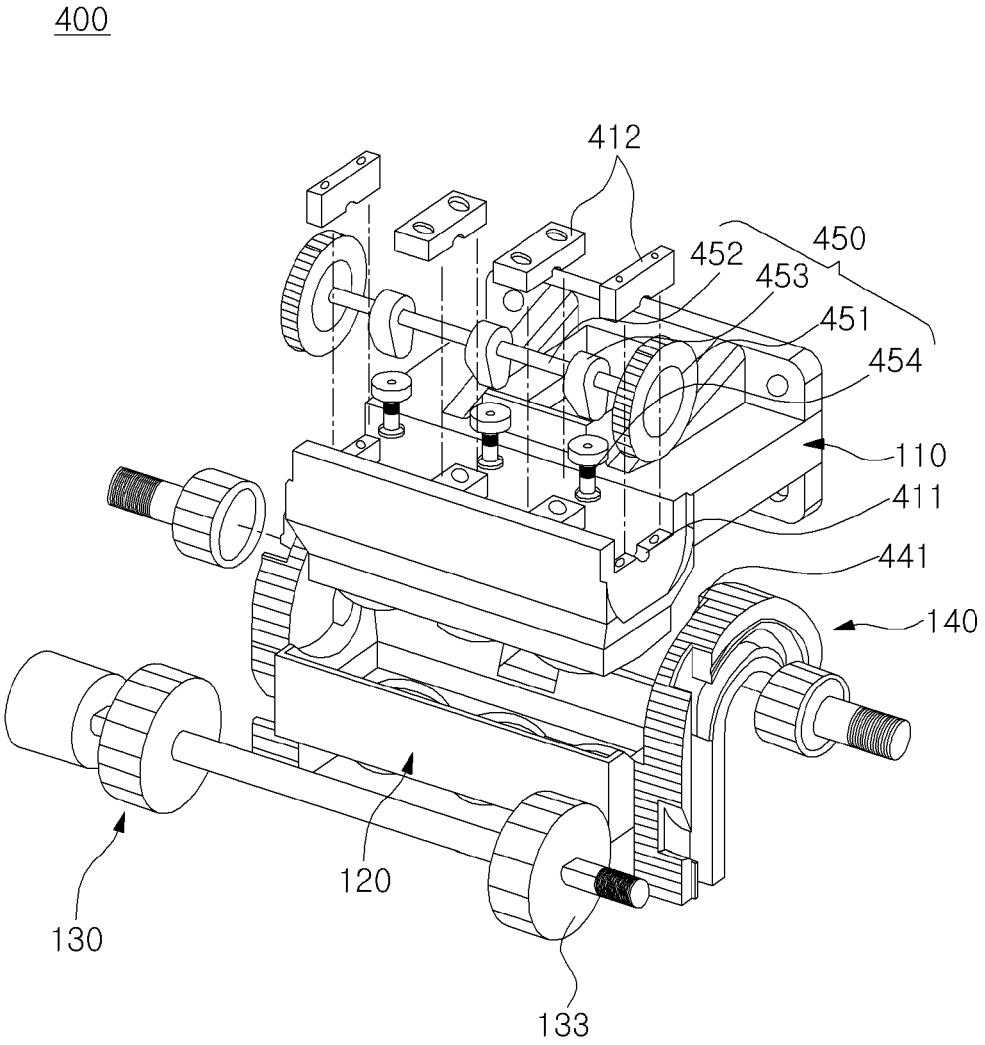
FIG. 21 is an exploded perspective view of an ice maker.
Figure 22:
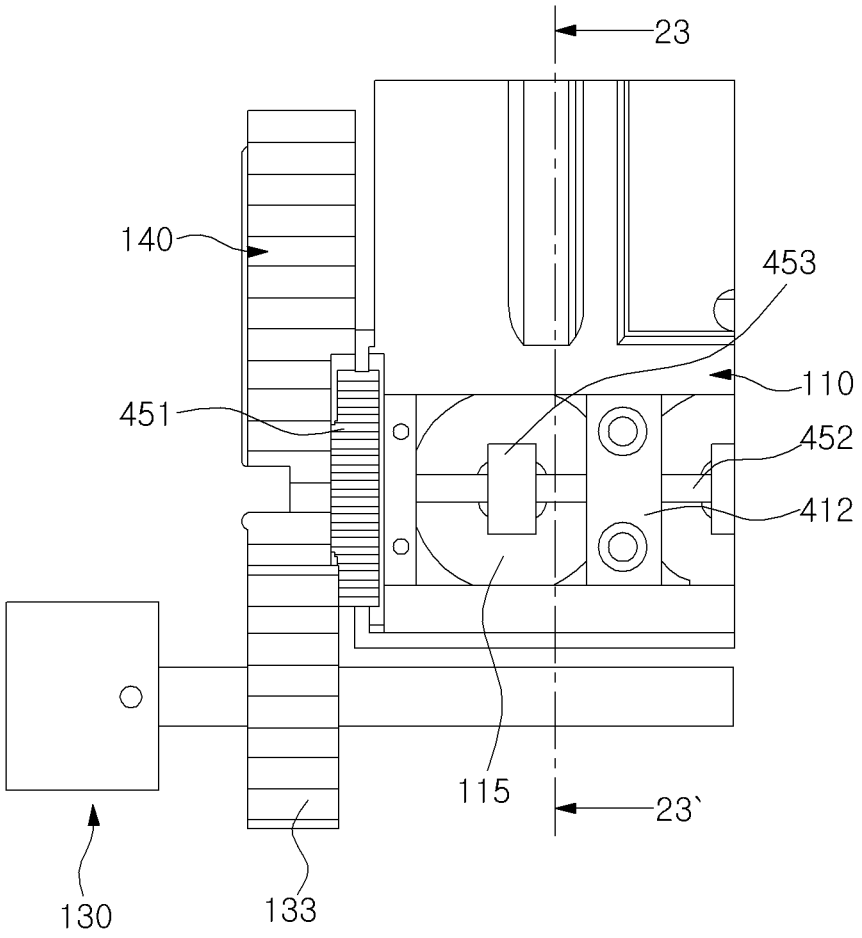
FIG. 22 is a plan view illustrating a coupling relationship between a driving unit and an ejecting unit of the ice maker.
Figure 23:
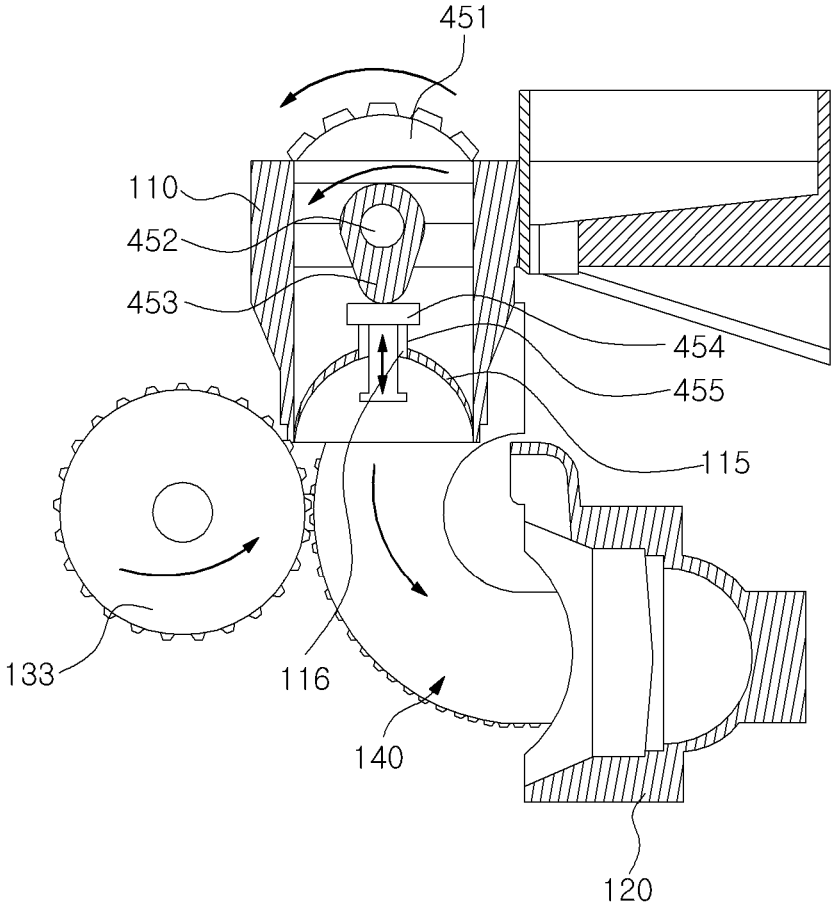
FIG. 23 is a cross-sectional view taken along line 23-23' of FIG. 22.
Figure 24:
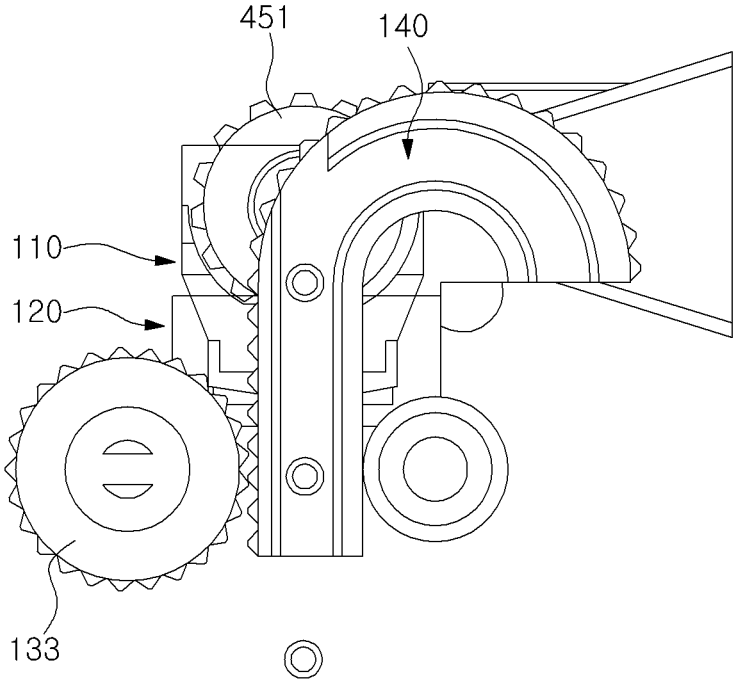
FIGS. 24 to 26 are views successively illustrating an ice separation process in the ice maker.
Figure 25:
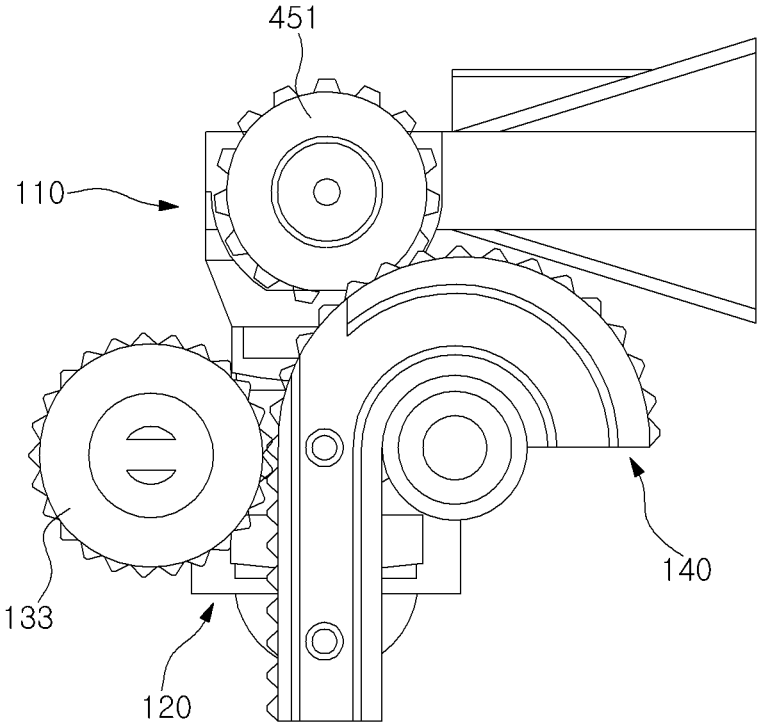
Figure 26:
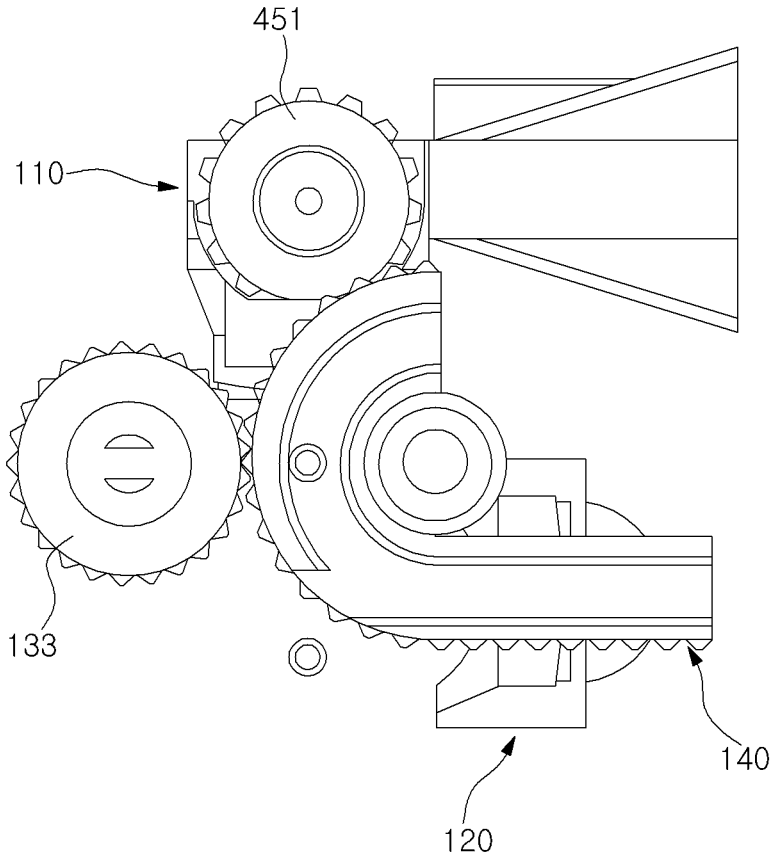

FIG. 21 illustrates an example ice maker. FIG. 22 illustrates an example coupling relationship between a driving unit and an ejecting unit of the example ice maker. FIG. 23 is a cross-sectional view taken along line 23-23' of FIG. 22. FIGS. 24 to 26 show views successively illustrating an example ice separation process in the example ice maker.

Referring to FIGS. 21 to 26, an ice maker 400 includes an upper tray 110 including an upper shell 115, a lower tray 120 including a lower shell 122, a driving unit 130 for vertically moving and rotating the lower tray 120, and an ejecting unit 450 for separating made ice pieces to the outside of a tray member. Also, the ejecting unit 450 includes a cam gear 451, a shaft 452, a cam 453, and an ejector 454.

In detail, the cam gear 451 is disposed on both sides of the upper tray 110 and connected to the shaft 452. The cam gear 451 may be disposed between a side surface of the upper tray 110 and a rack gear 140. Also, a cam gear receiving part 441 recessed outwardly is defined in an inner side surface of the rack gear 140 disposed on a position corresponding to that of the cam gear 451. The cam gear receiving part 441 may be formed by portions of a vertical part 141 and a rotation part 142 of the rack gear 140. Also, the cam gear receiving part 441 is disposed to stop the rack gear 140 from interfering with the cam gear 451 when the rack gear 140 is vertically moved.

The cam gear 451 may be engaged with gear teeth of the rotation part 142 in a state where the rack gear 140 is moved downward to separate ice. That is, the cam gear 451 is not rotated when the rack gear 140 is vertically moved, but is linked with the rack gear 140 when the rack gear 140 is rotated to separate ice.

A plurality of cams 453 may be provided on the shaft 452. The cams 453 are disposed above the upper shell 115 to correspond to the upper shell 115. The shaft 452 is seated on a shaft seat part 411 disposed on the upper tray 110. Also, the shaft 452 is rotatably mounted on the upper tray 110 by a shaft fixing member 412.

An ejector 454 is mounted on the upper shell 115. The ejector 454 is inserted into an air hole 116 and elastically supported by an elastic member 455. The ejector 454 has a top surface surface-contacting each of the cams 453. Thus, when the cam gear 451 is not rotated, the ejector 454 protrudes upward. On the other hand, when the cam gear 451 is rotated, the ejector 454 is pushed by a surface of the cam 453 to push an ice within the upper shell 115 downward.

Hereinafter, an example ice separation process of the ice maker 400 will be described.

After water for making ice pieces is supplied into the lower tray 120, the lower tray 120 is moved upward. As a result, the lower tray 120 is closely attached to the upper tray 110 as shown in FIG. 24. In this state, cool air is supplied to make ice. Here, the ejector 454 is supported by the elastic member 455 and disposed on the uppermost position thereof.

When the ice making process is finished in this state, a lower heater 152 is operated to melt a lower surface of ice, thereby separating the ice from the lower tray 120. In this state, the lower tray 120 is moved downward by the operation of the driving unit 130 to become in a state of FIG. 25. After the lower tray 120 is completely moved downward, the lower tray 120 is rotated as shown in FIG. 26 to open a lower side of the upper tray 110. Here, an ice piece is attached to the upper shell 115 of the upper tray 110. Also, when the rack gear 140 is vertically moved, the cam gear 451 is disposed inside the cam gear receiving part 441 to stop the cam gear 451 from interfering with the rack gear 140.

When the cam gear 451 is rotated in a state where the lower tray 120 is completely moved downward as shown in FIG. 25, the cam gear 451 is gear-coupled to the rack gear 140 and thus rotated. In detail, when the pinion gear 133 is rotated in a clockwise direction in a state of FIG. 25, the pinion gear 133 is gear-coupled to the rotation part 142 of the rack gear 140 to rotate the rack gear 140 in a counterclockwise direction.

When the rack gear 140 is rotated in the counterclockwise direction, the cam gear 451 is rotated in the clockwise direction, and thus the cams 453 mounted on the shaft 452 are rotated together with the cam gear 451. In the state of FIG. 26 in which the rack gear 140 is completely rotated, as shown in FIG. 22, the ejector 454 is pushed by a surface of the cam 453 to push the ice attached to the inside of the upper shell 115 downward. Thus, the made ice may be forcibly separated from the upper tray 110 and transferred downward.

According to another example, an ejecting unit may be disposed on a front side of an upper tray. Also, when the upper tray is moved upward and then rotated, the ejecting unit is inserted into the upper tray to separate an ice piece.

Figure 27:
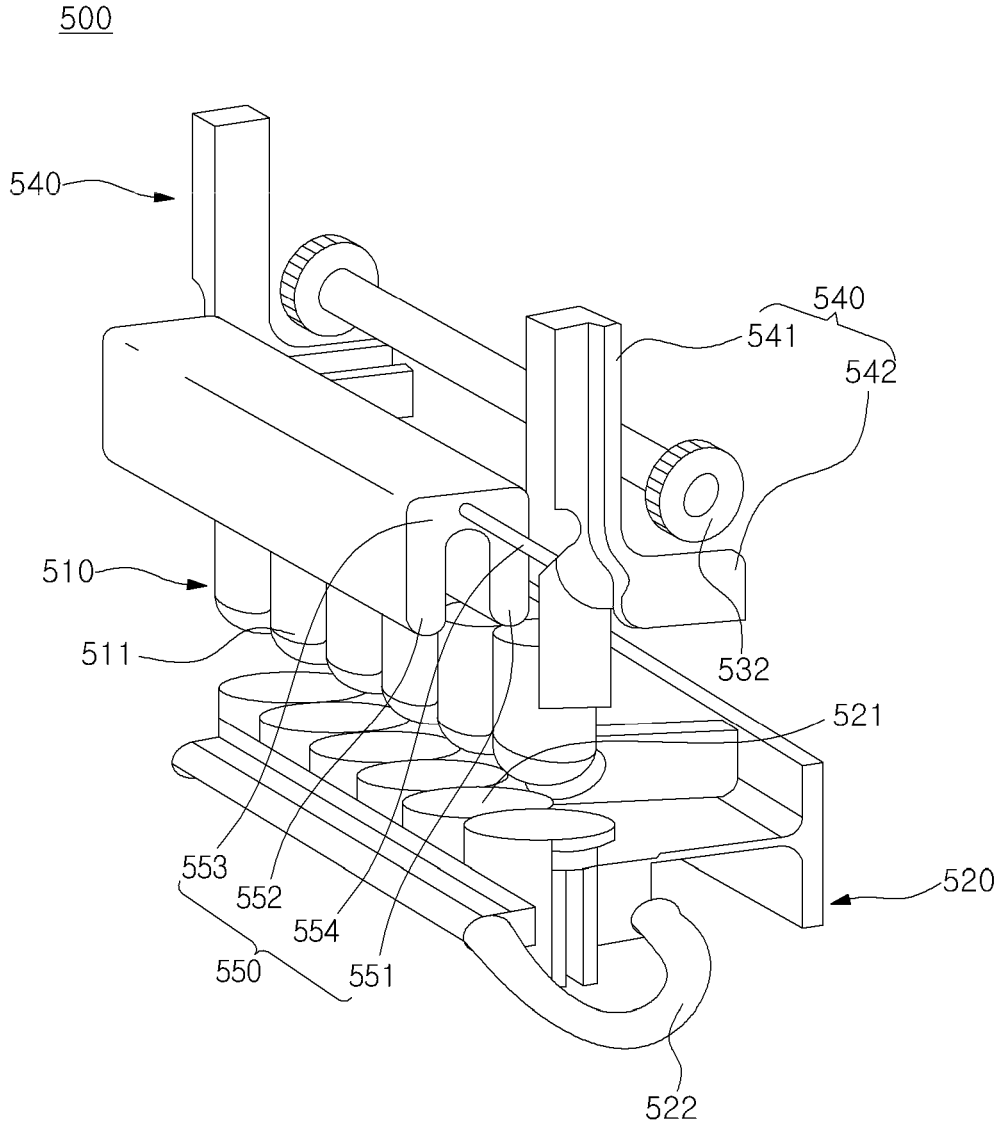
FIG. 27 is a perspective view of an ice maker.

FIG. 27 illustrates an example ice maker. FIGS. 28 to 31 show views successively illustrating an example ice separation process in the example ice maker.

Referring to FIGS. 27 to 31, an ice maker 500 includes a tray including an upper tray 510 and a lower tray 520, a driving unit 530 for opening or closing the tray, and an ejecting unit for separating ice made in the tray.

Unlike the above-described ice makers, the lower tray 520 is fixed to an ice maker case 501 or a side wall of a freezing compartment 104. Also, a plurality of lower shells 521 recessed in a hemispherical shape are successively arranged in the lower tray 520. Each of the lower shells 521 is closely attached to an upper shell 511 defined in the upper tray 510 to form a shell for making a globular or spherical ice piece.

The lower tray 520 may be formed of a metal material. Also, a heater 522 is disposed on the lower tray 520 to heat the lower tray 520 when ice pieces are separated, thereby easily separating the ice pieces.

The upper tray 510 is disposed above the lower tray 520. Also, the upper tray 510 may be vertically moved and rotated by the driving unit 530. The upper tray 510 may have a shape in which a plurality of cylinders are connected to each other. Also, the upper tray 510 has an opened top surface and a bottom surface recessed upward by the upper shell 511. The upper shell 511 may be formed of an elastically deformable material. Also, an air hole may be further defined in a top surface of the upper shell 511. Also, when the upper tray 510 is moved downward, the upper tray 510 may be inserted into the lower tray 520.

The driving unit 530 may vertically move and rotate the upper tray 510. Thus, the driving unit 530 includes a motor 531, a rack gear 540, and a pinion gear 532.

In detail, the rack gear 540 is disposed on both sides of the upper tray 510. Also, the rack gear 540 includes a vertical part 541 extending upward and a rotation part 542 laterally extending from a lower end of the vertical part 541. The rack gear 540 has gear teeth engaged with the pinion gear 532 on a rear side surface (a right side in FIG. 28) thereof. Thus, when the pinion gear 532 is rotated, the rack gear 540 may be vertically moved and rotated.

Also, a guide groove 543 is defined in an outer side surface of the rack gear 540. A guide protrusion 544 disposed on the case 501 is inserted into the guide groove 543. The guide groove 543 and the guide protrusion 544 have the same structure as those discussed above.

The ejecting unit 550 is configured to separate an ice piece attached to the upper tray 510. The ejecting unit 550 is disposed on a front side of the upper tray 510. Also, the ejecting unit 550 includes an insertion part 551, a push part 552, a connection part 553, and a rotation shaft part 554.

The insertion part 551 and the push part 552 extend downward and have a "ㄷ" shape by the connection part 553. The insertion part 551 is inserted into a top surface of the upper tray 510 when the upper tray 510 is rotated to separate a made ice piece. The push part 552 pushes the outside of the upper tray 510 in a state where the insertion part 551 is inserted into the upper tray 510 to reduce shaking of the ejecting unit 550. The rotation shaft part 554 extends from both sides of the connection part 553 so that the ejecting unit 550 is rotatably mounted. When the rotation shaft part 554 is mounted on the case 501, the push part 552 is inclined so that an end thereof gradually approaches toward the insertion part 551.

Also, the rotation shaft part 554 may be disposed above a rotation shaft of the lower tray 520, for instance, above a rotation shaft of the pinion gear 532. When the upper tray 510 is not rotated, a lower end of the insertion part 551 is disposed above an opened top surface of the upper tray 510. Also, the insertion part 551 may be provided in plurality so that the plurality of insertion parts 551, respectively, push the plurality of upper shells 511. That is, the insertion parts 551 may have numbers corresponding to the number of upper shells 511 and be arranged with the same distance as each other.

Hereinafter, an example ice separation process of the ice maker 500 will be described.

Figure 28:
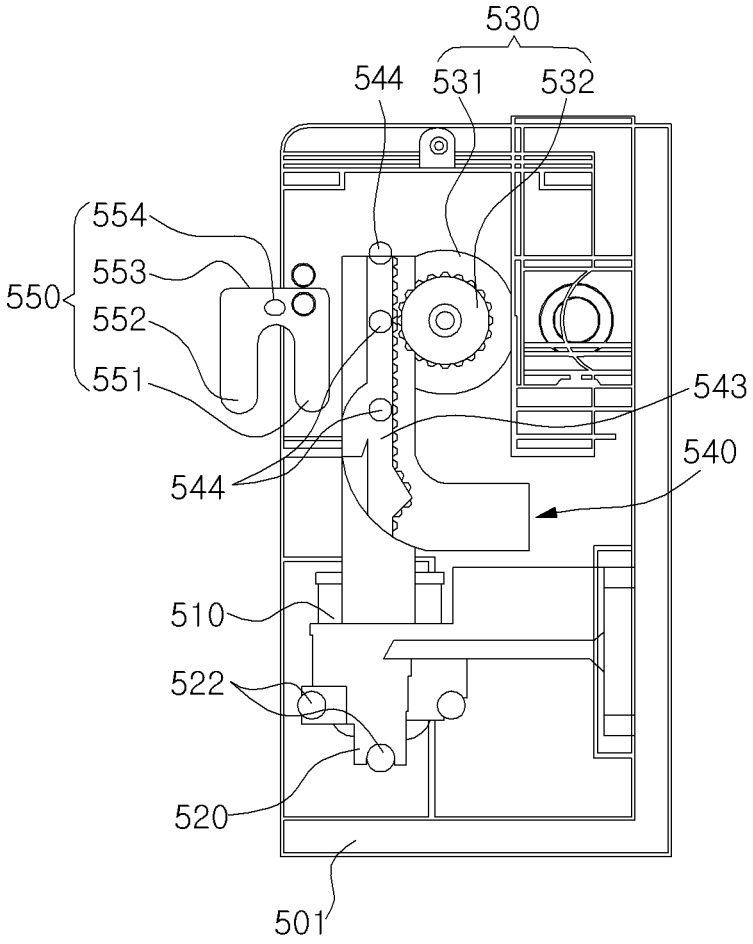
FIGS. 28 to 31 are views successively illustrating an ice separation process in the ice maker.

After water for making ice within the lower tray 520 is supplied into the lower shells 521, the upper tray 510 is moved downward in a state where the lower tray 520 is fixed. A lower end of the upper tray 510 moved downward is inserted into the lower tray 520, as shown in FIG. 28. Thus, the upper shell 511 and the lower shell 521 contact each other to make a globular or spherical ice piece in the globular or spherical cell.

When the ice making process is finished in this state, the lower heater 522 is operated to melt a lower surface of the made ice contacting the lower shell 521, thereby separating the ice from the lower tray 520. In this state, the upper tray 510 is linearly moved upward by the operation of the driving unit 530 to become in a state of FIG. 29. When the upper tray 510 ascends up to the uppermost position thereof, an end of the insertion part 551 is disposed directly above the upper shell 510.

Figure 29:
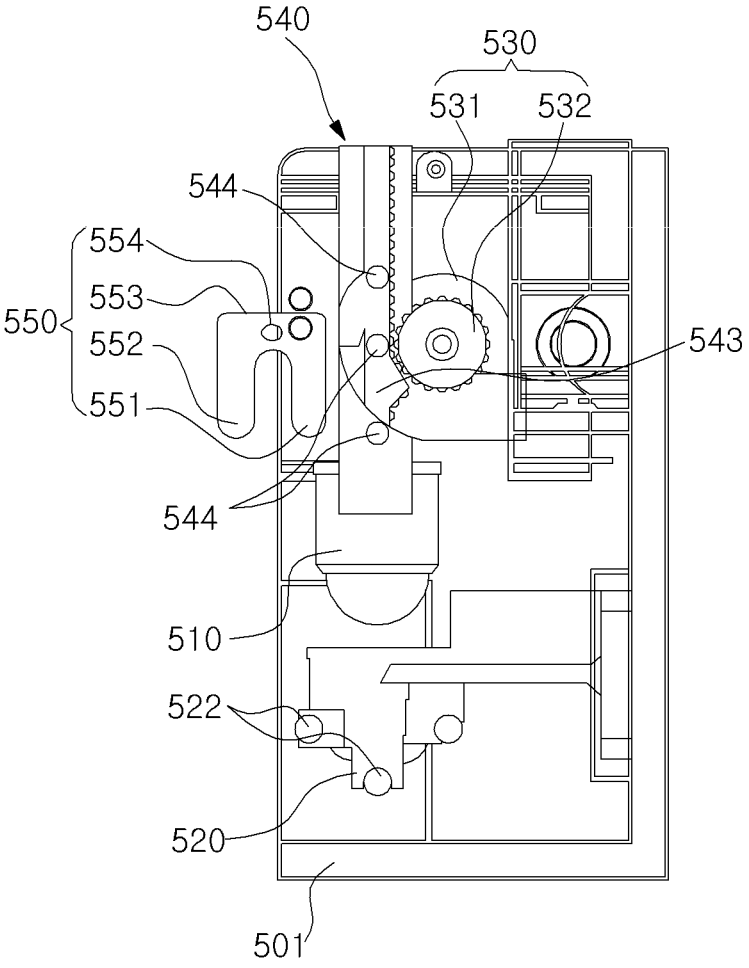

When the pinion gear 532 is further rotated in the state of FIG. 29, the rack gear 540 is rotated in a clockwise direction. When the rack gear 540 is rotated, the upper tray 510 may be rotated also in the clockwise direction.

Figure 30:
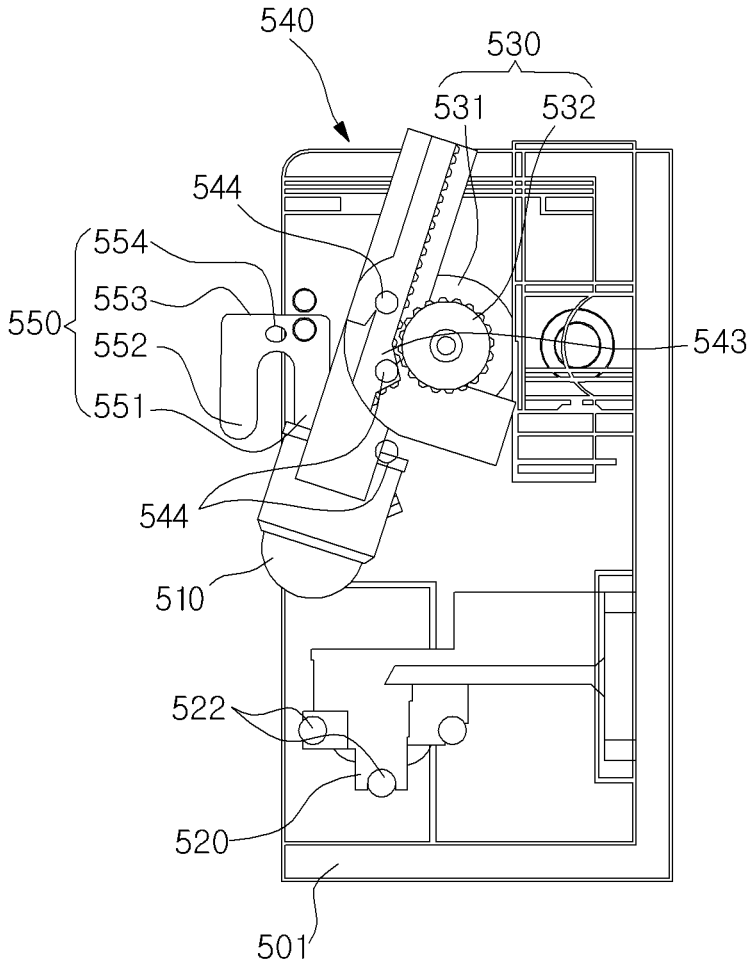
Figure 31:
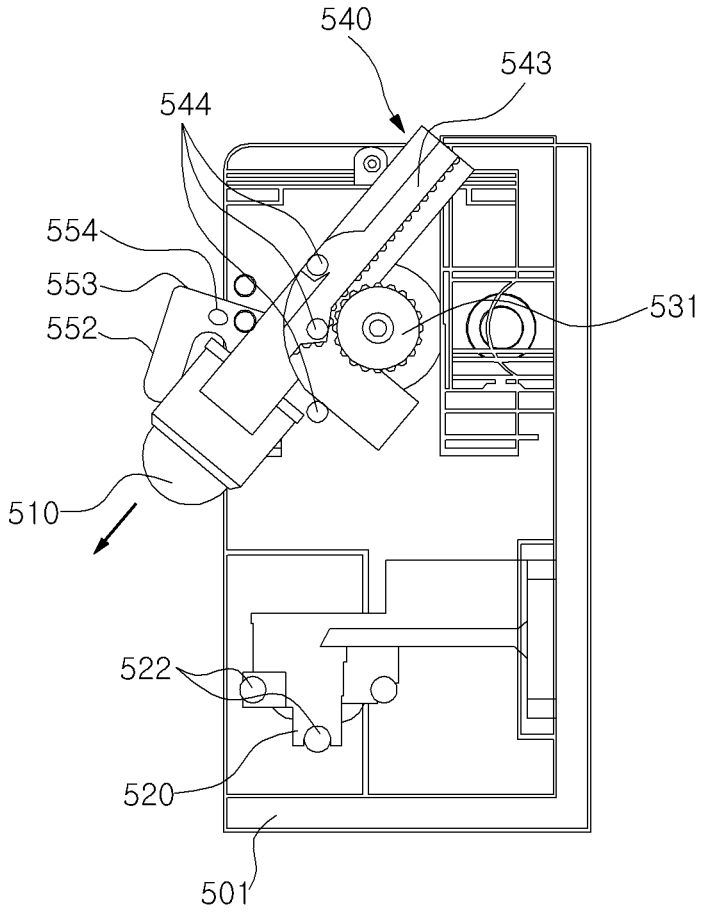

At the same time, as shown in FIG. 30, a portion of the insertion part 551 may be smoothly inserted into the opened top surface of the upper tray 510. When the upper tray 510 is rotated, a front portion of the upper tray 510 (e.g., a front portion of a cylindrical portion) contacts the push part 552. In this state, when the upper tray 510 is further rotated as shown in FIG. 31, the ejecting unit 550 may be rotated together with the upper tray 510. As a result, the push part 552 is rotated, and thus, the insertion part 551 is further inserted into the upper tray 510. Also, an end of the push part 552 pushes the upper shell 511 of the upper tray 510 to assist in separating the ice.

As shown in FIG. 31, in the state where the upper tray 510 is completely rotated, the insertion part 551 pushes the upper shell 511 from an upper side to separate the ice within the upper shell 511 to the outside.

Figure 32:
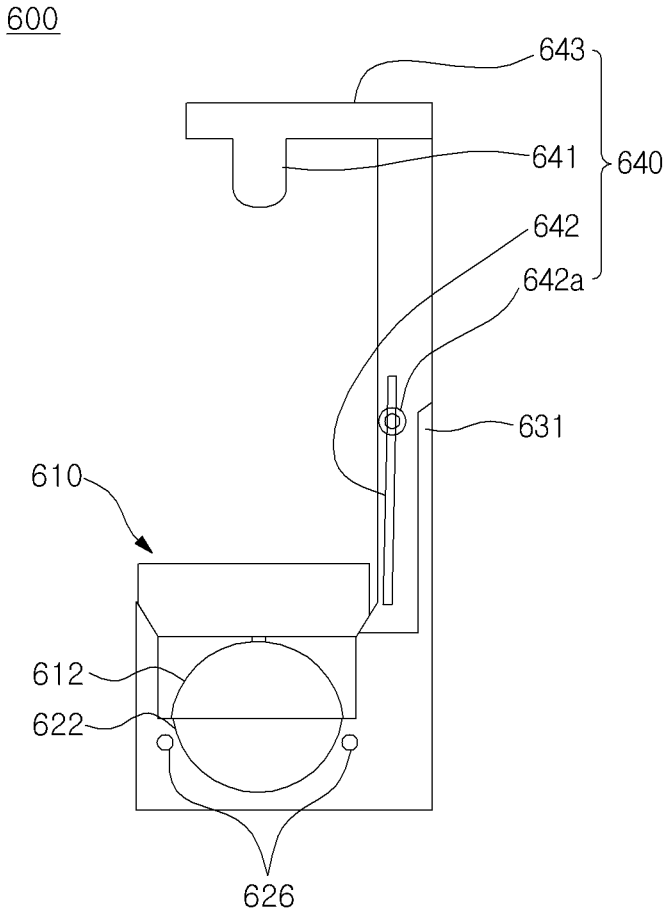
FIGS. 32 to 34 are views successively illustrating an ice separation process in an ice maker.
Figure 33:
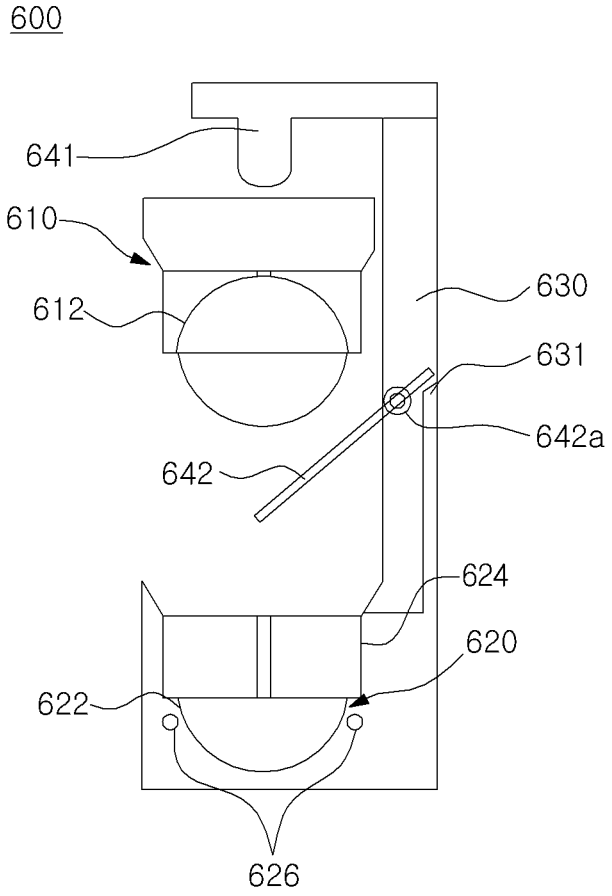
Figure 34:
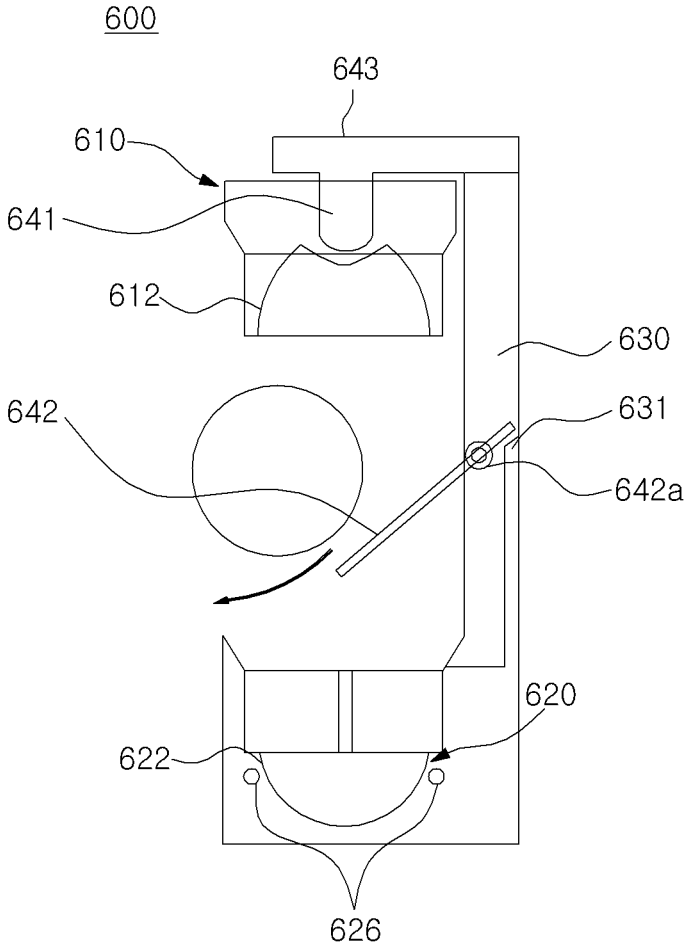

FIGS. 32 to 34 show views successively illustrating an example ice separation process in an example ice maker.

Referring to FIGS. 32 to 34, an ice maker 600 includes a tray including an upper tray 610 and a lower tray 620 which form shells for making globular or spherical ice pieces, a driving unit including a motor for opening or closing the tray, and an ejecting unit 640 for separating the ice pieces made in the tray.

The lower tray 620 is fixed to a case or an inner side of a refrigerator. Also, a plurality of lower shells 622 recessed in a hemispherical shape are successively arranged in the lower tray 620. Each of the lower shells 622 is closely attached to an upper shell 612 defined in the upper tray 610 to form a globular or spherical shell.

The lower tray 620 may be formed of a metal material. Also, a heater 626 is disposed on the lower tray 620 to heat the lower tray 620 when ice pieces are separated, thereby easily separating the ice pieces.

A frame 630 that vertically extends upward is disposed on a rear surface of the lower tray 620. The frame 630 may have a predetermined height. Also, an ejecting pin 641 which is one part of the ejecting unit 640 is disposed on a top surface of the frame 630. The ejecting pin 641 extends downward from a bottom surface of a plate 643 extending forward from the top surface of the frame 630 by a predetermined length.

Also, the upper tray 610 is disposed above the lower tray 620. Also, the upper tray 610 may be vertically moved by the driving unit. The upper tray 610 may have a shape in which a plurality of cylinders are connected to each other. Also, the upper tray 610 has an opened top surface and a bottom surface in which the upper shells 612 are defined. The upper shell 612 may be formed of an elastically deformable material. Also, an air hole passing through the upper shell 612 may be further defined in an upper end of the upper shell 612. A water chamber 624 is disposed on a top surface of the lower shell 622. Water is filled up to the water chamber 624. The water filled into the water chamber 624 may be introduced into the upper shell 612 when the upper shell 612 is closely attached to the lower shell 622 using techniques similar to those discussed above.

When the upper tray 610 is moved downward, the upper tray 610 may be inserted into the lower tray 620. Here, the upper shell 612 is coupled to the lower shell 622 to form a globular or spherical shell.

A pinion gear may be mounted on a general motor, and a rack gear may be mounted on the upper tray 610 to vertically move the upper tray 610.

Also, an ice separation guide 642 for guiding an ice separated from the upper tray 610 into a front side of the lower tray 620 may be disposed on the frame 630. The ice separation guide 642 together with the ejecting pin 641 constitutes the ejecting unit 640. The ice separation guide 642 is rotatably mounted on any position of the frame 630.

In detail, the ice separation guide 642 may have a rod or plate shape with a predetermined length. An elastic member 642*a*, such as a torsion spring, may be disposed on a rotation shaft of the ice separation guide 642 to maintain a state in which the ice separation guide 642 is forwardly rotated at a predetermined angle as shown in FIG. 33, even though an external force is not applied. Also, at least a portion of an upper portion of the lower tray 620 may be covered.

When the upper tray 610 is moved upward, the ice separation guide 642 is pressed by a rear side surface of the upper tray 610. Thus, the ice separation guide 642 may be closely attached to a front surface of the frame 630. Also, a stopper 631 for restricting a rotation angle of the ice separation guide 642 may be disposed on the frame 630. Thus, the rotation of the ice separation guide 642 may be restricted by the stopper 631. In this state, the ice separation guide 642 may guide ice pieces dropped in an inclined state into a front side.

Hereinafter, an operation of the ice maker 600 will be described.

First, the upper tray 610 is moved upward to supply water for making an ice piece into the lower shell 622 in a state where a top surface of the lower tray 620 is opened. After a preset amount of water that is enough to fill the shells is supplied, the upper tray 610 is moved downward. When a lower portion of the upper tray 610 is inserted into the water chamber 624 of the lower tray 620 and then completely moved downward, the ice maker 600 becomes in a state of FIG. 32.

In this state, the upper shell 612 and the lower shell 622 are closely attached to each other, and the water filled into the globular or spherical shell is frozen. Then, when a predetermined time elapses, the water within the shell may be completely frozen to make a globular or spherical ice piece.

In the state in which the ice piece is completely made, a heater 626 mounted on the lower tray 620 is operated in a state of FIG. 32 so as to separate the ice piece. Thus, the heater 626 is operated to heat the lower tray 620. A surface of an ice piece contacting the lower shell 622 is melted to easily separate the ice piece from the lower tray 620. Here, the ice separation guide 642 is closely attached to the frame 630 in a state where the ice separation guide 642 is pushed by the upper tray 610. Also, the elastic member 642*a* is maintained in the pressed state.

When the operation of the heater 626 is finished, the upper tray 610 is moved upward. When the upper tray 610 is moved upward, the made ice piece is moved upward in a state where the ice is attached to the upper shell 612 to become in a state of FIG. 33.

As described above, as the upper tray 610 is moved higher than the ice separation guide 642, the external force applied to the ice separation guide 642 is removed. Thus, the ice separation guide 642 is rotated in the clockwise direction by a restoring force of the elastic member 642*a* and then is unfolded.

As shown in FIG. 33, in the state where the ice separation guide 642 is completely unfolded, a rear end of the ice separation guide 642 is supported by a support part 631 disposed on the frame 630 to maintain the inclined state of the ice separation guide 642.

In a state of FIG. 33, when the upper tray 610 is further moved upward, the ejecting pin 641 and the upper shell 612 contact each other. Also, in a state where the upper tray 610 is moved to the uppermost position, the ejecting pin 641 pushes an upper portion of the upper shell 612 as shown in FIG. 34.

Here, since the upper shell 612 is formed of an elastically deformable material, the upper shell 612 is deformed by the ejecting pin 641, and thus the ice piece attached to the upper shell 612 drops down. The globular or spherical ice piece dropping from the upper tray 610 contacts the ice separation guide 642 and then moves along the ice separation guide 642. As a result, the ice piece may be moved in a front side of the lower tray 620. Thus, the made ice piece may exit the ice maker 600 and then be stored in a separate ice bank.

After the ice is separated through the above-described processes, water is supplied again. Then, the above-described processes may be repeatedly and successively performed to make ice pieces.

According to the described example ice makers, when water is supplied in a state where the upper tray and the lower tray are closed, ice pieces may be made within the plurality of shells, each providing a space having a globular or spherical shape. Thus, globular or spherical ice pieces may be made to minimize a contact area between the ice pieces when the ice pieces are stored, thereby reducing the likelihood of the ice pieces being matted with respect to each other. Therefore, storability and convenience in use may be improved.

Also, a portion of the upper tray may be inserted into the lower tray so the upper tray and the lower tray are coupled to match each other. Thus, an ice piece having a substantially globular or spherical shape may be made within the shell to improve ice making performance.

Also, generation of heat for separating the ice pieces may be minimized in the ice maker by the ejecting unit disposed above the upper tray. Thus, the cooling performance and power consumption may be improved.

Also, since the ice may be separated by the vertically moving ejector, the ice may be mechanically separated. Thus, the ice separation operation having more reliability may be performed.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses also are apparent to those skilled in the art.

What is claimed is:

1. An ice maker comprising:

a tray member comprising:

an upper tray having an upper shell; and a lower tray having a lower shell;

a driving unit disposed on a side of the tray member and configured to linearly move, in a vertical direction, at least one of the upper tray and the lower tray to change between an attached orientation in which the upper shell is attached to the lower shell to define a spherical shell and a separated orientation in which the upper shell is separated from the lower shell; and an ejecting unit that is disposed on a side of the tray member and that is configured to facilitate separation of an ice piece made in the spherical shell from at least one of the upper tray and the lower tray, wherein the driving unit comprises:

a motor configured to provide a rotation force;

a pinion gear connected to a rotation shaft of the motor; and a rack gear disposed on a side surface part of the lower tray, the rack gear being engaged with the pinion gear to move the lower tray, wherein the rack gear comprises:

a vertical part configured to vertically move the lower tray; and a rotation part that is bent with a predetermined curvature from an upper end of the vertical part and that is configured to rotate the lower tray.

2. The ice maker according to claim 1, wherein the driving unit is configured to move the lower tray downward and then rotate the lower tray to facilitate separation of the ice piece.

3. The ice maker according to claim 1, further comprising:

a guide groove defined in a side surface of the rack gear; and a guide protrusion that protrudes from a side surface of a case in which the tray member is received, the guide protrusion being fitted into the guide groove to guide movement of the rack gear.

4. The ice maker according to claim 1, further comprising a guide roller that contacts a surface of the rack gear opposite to that on which the rack gear is engaged with the pinion gear.

5. The ice maker according to claim 1, further comprising:

a water supply unit disposed on the upper tray to supply water into the lower shell, and a water supply guide part defined in the lower tray and configured to guide the water supplied from the water supply unit into the lower shell.

6. The ice maker according to claim 1:

wherein the ejecting unit comprises:

a lower heater mounted on an outer surface of the lower tray;

an ejecting rack gear elevated by being engaged with the pinion gear;

a link having a first end connected to the ejecting rack gear; and an ejector connected to a second end of the link, the ejector passing through a top surface of the upper shell to separate the ice piece from the upper shell.

7. The ice maker according to claim 6, wherein a position of the link is rotatably connected to the upper tray.

8. The ice maker according to claim 7, wherein the ejector includes:

a connection part horizontally extending and connected to the second end of the link; and a plurality of ejecting pins extending from the connection part to be inserted in the upper shells.

9. The ice maker according to claim 8, further comprising:

a pair of long holes formed at the first and the second ends of the link; and a pair of coupling members respectively passing through the pair of long holes to be respectively inserted into the ejecting rack gear and the connection part.

* * * * *